US008639157B2

(12) United States Patent
Okabe

(10) Patent No.: US 8,639,157 B2
(45) Date of Patent: Jan. 28, 2014

(54) IMAGE FORMING APPARATUS AND PHOTOSENSITIVE UNIT

(71) Applicant: Yasushi Okabe, Nagoya (JP)

(72) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/633,331

(22) Filed: Oct. 2, 2012

(65) Prior Publication Data

US 2013/0022370 A1 Jan. 24, 2013

Related U.S. Application Data

(63) Continuation of application No. 13/337,808, filed on Dec. 27, 2011, now Pat. No. 8,306,452, which is a continuation of application No. 12/408,755, filed on Mar. 23, 2009, now Pat. No. 8,107,853.

(30) Foreign Application Priority Data

Mar. 25, 2008 (JP) ..... 2008-077518

(51) Int. Cl.
*G03G 15/00* (2006.01)
*G03G 21/16* (2006.01)

(52) U.S. Cl.
USPC ..... 399/110; 399/90

(58) Field of Classification Search
USPC ..... 399/110, 111, 90, 116, 117
See application file for complete search history.

(56) References Cited

U.S. PATENT DOCUMENTS

| | | | | |
|---|---|---|---|---|
| 4,714,337 | A | 12/1987 | Nishino et al. | |
| 4,829,335 | A | 5/1989 | Kanemitzu et al. | |
| 6,892,033 | B2 | 5/2005 | Sunada et al. | |
| 7,697,866 | B2 | 4/2010 | Murayama | |
| 7,761,023 | B2 | 7/2010 | Sato | |
| 7,769,318 | B2 | 8/2010 | Okabe | |
| 7,783,226 | B2 | 8/2010 | Tomatsu | |
| 7,873,301 | B2 | 1/2011 | Ishii | |
| 8,107,853 | B2 * | 1/2012 | Okabe | 399/110 |
| 8,306,452 | B2 * | 11/2012 | Okabe | 399/110 |
| 2003/0053819 | A1 | 3/2003 | Nomura et al. | |
| 2003/0156848 | A1 | 8/2003 | Kawai et al. | |

(Continued)

FOREIGN PATENT DOCUMENTS

| | | |
|---|---|---|
| JP | 2003-015378 | 1/2003 |
| JP | 2003-223091 | 8/2003 |
| JP | 2007264469 | 10/2007 |

OTHER PUBLICATIONS

Notification of Reasons for Refusal for Japanese Patent Application No. 2008-077518 mailed Nov. 9, 2010.

(Continued)

*Primary Examiner* — Susan Lee
(74) *Attorney, Agent, or Firm* — Banner & Witcoff, Ltd.

(57) ABSTRACT

An image forming apparatus may include a moving unit configured to support a cartridge and to slide in a generally horizontal direction between multiple positions. For example, the positions may include a first position where the moving unit is located inside the main body and a second position where the moving unit is located outside the main body. Additionally or alternatively, the moving unit being may also move between the first position and a third position located below the first position. The moving unit may also be configured to electrically connect electrodes based on its movement.

5 Claims, 16 Drawing Sheets

(56) References Cited

U.S. PATENT DOCUMENTS

| | | | |
|---|---|---|---|
| 2006/0008288 | A1 | 1/2006 | Kuma et al. |
| 2007/0077087 | A1 | 4/2007 | Okabe et al. |
| 2007/0230998 | A1 | 10/2007 | Ishii |
| 2007/0286632 | A1 | 12/2007 | Okabe |
| 2008/0159774 | A1 | 7/2008 | Tanabe et al. |
| 2010/0135692 | A1 | 6/2010 | Abe et al. |
| 2011/0076050 | A1 | 3/2011 | Okabe |

OTHER PUBLICATIONS

Notice of Rejection in corresponding Japanese Application 2008-077518, mailed Jun. 29, 2010.

* cited by examiner

IMAGE FORMING APPARATUS AND PHOTOSENSITIVE UNIT

CROSS REFERENCE TO RELATED APPLICATION

This application is a continuation of and claims the benefit of priority from U.S. application Ser. No. 13/337,808, filed on Dec. 27, 2011, entitled "Image Forming Apparatus and Photosensitive Unit," which is a continuation of U.S. application Ser. No. 12/408,755, filed on Mar. 23, 2009, entitled "Image Forming Apparatus and Photosensitive Unit," which issued as U.S. Pat. No. 8,107,853, and which claims priority to Japanese Patent Application No. 2008-77518 filed on Mar. 25, 2008. The contents of the above noted applications are hereby incorporated into the present application by reference in their entirety.

TECHNICAL FIELD

The present invention relates to an image forming apparatus such as a color laser printer and a photosensitive unit mounted on the image forming apparatus.

BACKGROUND

For example, there is proposed a so-called color image forming apparatus, in which a photosensitive unit including a plurality of photosensitive members, chargers charging the photosensitive members, developing rollers feeding developing agents to the photosensitive members and cleaning brushes capturing foreign matter adhering to the photosensitive members in response to the colors of the developing agents, is detachably mounted.

In the image forming apparatus, wire electrodes applying biases to discharge wires of the chargers, grid electrodes applying biases to grids of the chargers, developing roller electrodes applying biases to the developing rollers and cleaning electrodes applying biases to the cleaning brushes are provided on the same side surface of a drum unit as the photosensitive unit in response to the colors respectively. These electrodes come into contact with contacts individually provided on the main body of the image forming apparatus when the drum unit is mounted in the main body of the apparatus, to be fed with power from the main body of the apparatus.

Among these electrodes, the wire electrodes and the cleaning electrodes are arranged on the same straight line extending along a direction for mounting or dismounting the photosensitive unit in or from the main body of the apparatus, while the grid electrodes and the developing roller electrodes are arranged on the same straight line extending along the direction for mounting or dismounting the photosensitive unit in or from the main body of the apparatus, to form a train parallel to a train of the wire electrodes and the cleaning electrodes at an interval.

In the photosensitive unit, the intervals between the adjacent electrodes must be generally increased, in order to reliably bring the electrodes and the corresponding contacts provided on the main body of the apparatus into contact with one another and to prevent an electric leak between the electrodes. In particular, the interval between the train of the wire electrodes and the cleaning electrodes and the train of the grid electrodes and the developing roller electrodes must be increased. In this case, however, the degree of freedom in design may be reduced.

SUMMARY

One aspect of the present invention may provide a photosensitive unit capable of improving the degree of freedom in design when a plurality of electrodes are so arranged as to form parallelly extending trains and an image forming apparatus with which the photosensitive unit is mounted.

The same or different aspect of the present invention may provide an image forming apparatus including: a main body provided with an accommodation chamber partitioned by an inner side surface; a photosensitive unit, slidable between an accommodated position where the photosensitive unit is accommodated in the accommodation chamber and a drawn position where the photosensitive unit is drawn from the accommodation chamber, holding a plurality of photosensitive members parallelly arranged along the sliding direction of the photosensitive unit; a first electrode provided on a first outer side surface formed on the photosensitive unit to extend along the sliding direction while being opposed to the inner side surface in an orthogonal direction orthogonal to the sliding direction; a second electrode provided on a second outer side surface formed on the photosensitive unit to protrude toward the inner side surface beyond the first outer side surface in the orthogonal direction while extending in parallel with the first outer side surface; a third electrode provided on a first inner side surface formed on the inner side surface to extend along the sliding direction, to be opposed to the first electrode at an interval in the orthogonal direction as viewed from the sliding direction when the photosensitive unit is located between the accommodated position and the drawn position, and to come into contact with the second electrode along the orthogonal direction when the photosensitive unit is located on the accommodated position; and a fourth electrode provided on a second inner side surface formed on the inner side surface to extend in parallel with the first inner side surface and to protrude toward the photosensitive unit beyond the first inner side surface in the orthogonal direction, to be opposed in the orthogonal direction to a third outer side surface opposite to the second outer side surface with respect to the first outer side surface in the photosensitive unit when the photosensitive unit is located between the accommodated position and the drawn position, and to come into contact with the first electrode along the orthogonal direction when the photosensitive unit is located on the accommodated position.

One or more aspects of the present invention provide a photosensitive unit slidably mounted in/dismounted from a main body of an image forming apparatus provided with an accommodation chamber partitioned by an inner side surface, including: a plurality of photosensitive members parallelly arranged along the sliding direction of the photosensitive unit, on which electrostatic latent images are formed; a plurality of first process members provided correspondingly to the plurality of photosensitive members, for visualizing the electrostatic latent images formed on the photosensitive members; a plurality of second process members provided correspondingly to the plurality of photosensitive members separately from the first process members, for visualizing the electrostatic latent images formed on the photosensitive members; a first electrode provided on a first outer side surface formed on the photosensitive unit to extend along the sliding direction while being opposed to the inner side surface in an orthogonal direction orthogonal to the sliding direction, and connected to an electrode of the main body thereby feeding power received from the electrode of the main body to the first process members; and a second electrode provided on a second outer side surface formed on the photosensitive unit to protrude toward the inner side surface beyond the first outer side surface in the orthogonal direction while extending in parallel with the first outer side surface, and connected to the electrode of the main body thereby feeding power received from the electrode of the main body to the second process members.

DETAILED DESCRIPTION

Embodiments of the present invention are now described with reference to the drawings.

First Embodiment

Overall Structure of Printer

Figure 1:
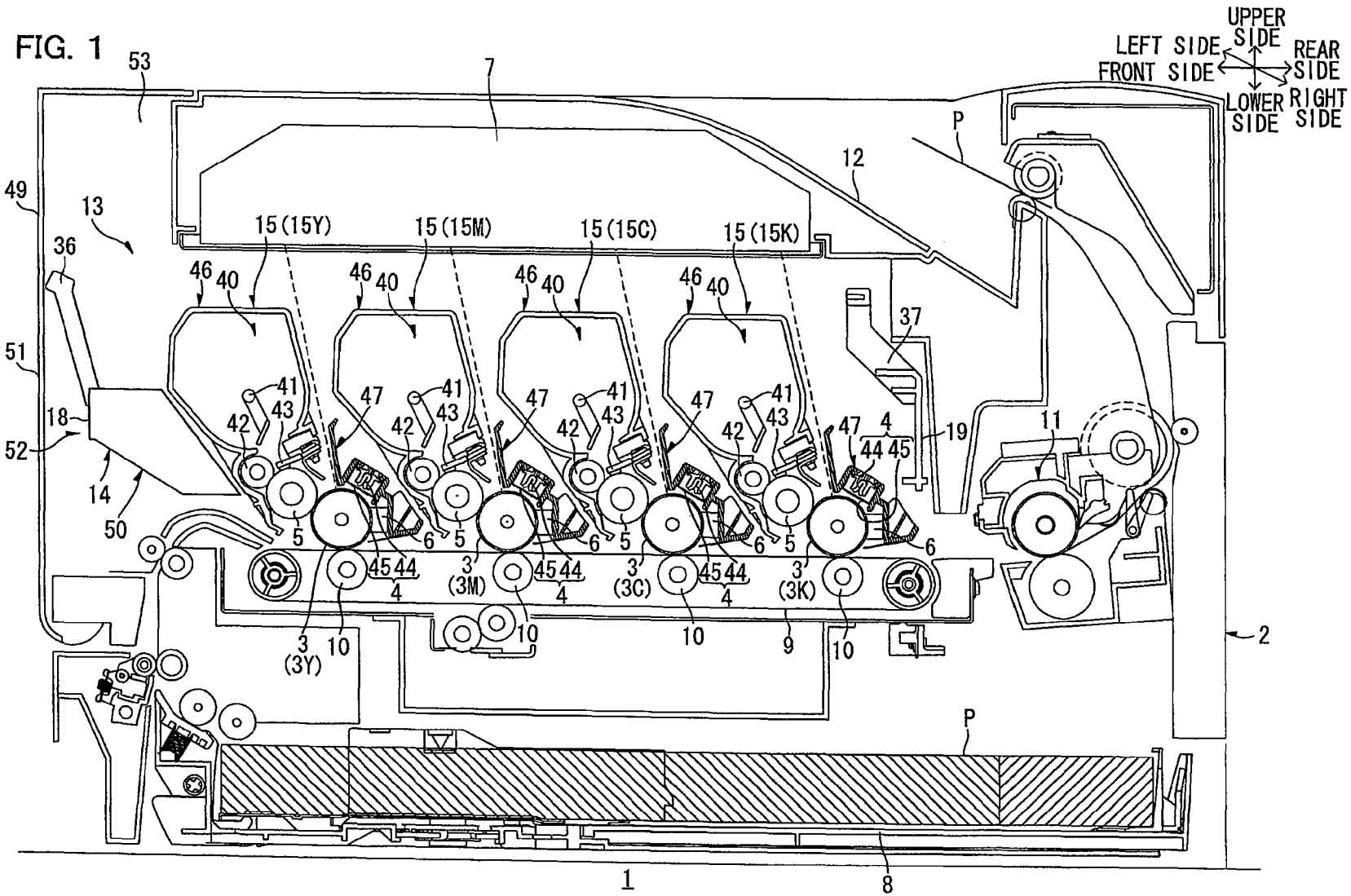
FIG. 1 is a right side sectional view showing illustrative aspects of a printer as an example of an image forming apparatus of one or more aspects of the present invention.
Figure 2:
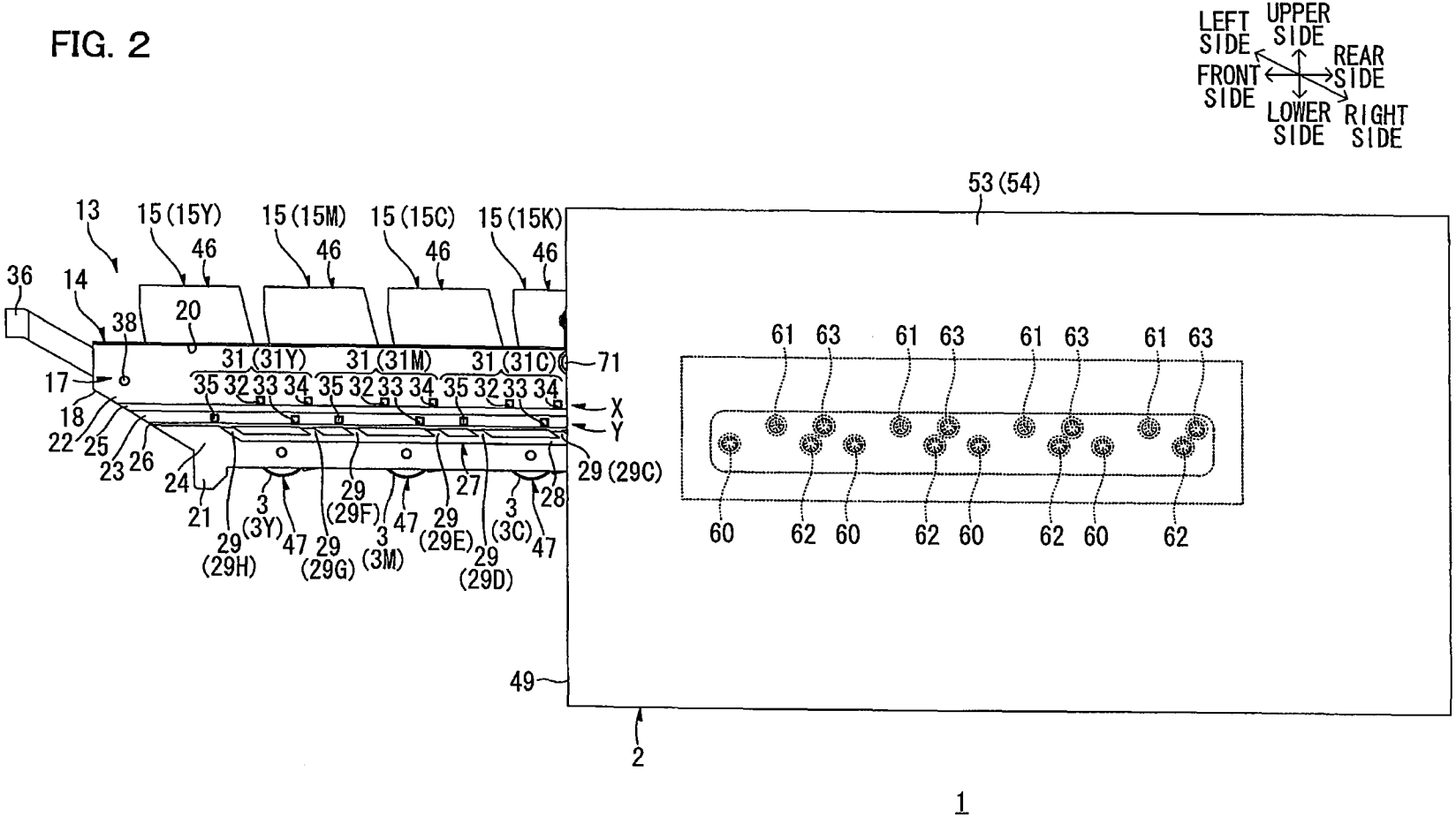
FIG. 2 is a right side elevational view of the printer in a state where a drum unit is located at a drawn position.

FIG. 1 is a right side sectional view showing illustrative aspects of a printer as an example of an image forming apparatus of one or more aspects of the present invention. Directions are mentioned with reference to illustrated arrows (this also applies to the remaining drawings). The right-and-left direction and the width direction are identical to each other.

The printer 1 is a color printer. As show in FIG. 1, the printer 1 includes four photosensitive drums 3 having central axes extending in the width direction, which are arranged in line along the anteroposterior direction, as examples of photosensitive members in a main body casing 2 as an example of the main body of the image forming apparatus. The four photosensitive drums 3 are hereinafter classified into a photosensitive drum 3K (black), a photosensitive drum 3C (cyan), a photosensitive drum 3M (magenta) and a photosensitive drum 3Y (yellow), in response to the colors (black, cyan, magenta and yellow) of toner images (described later) formed on the photosensitive drums 3 respectively. A charger 4 such as a scorotron charger, for example, a developing roller 5 and a cleaning brush 6 are opposed to each photosensitive drum 3.

A scanner unit 7 is arranged above these photosensitive drums 3, so that the surface of each photosensitive drum 3 is exposed to a laser beam (see the broken line in FIG. 1) emitted from the scanner unit 7 based on image data after the same is uniformly charged by the charger 4. Thus, an electrostatic latent image based on the image data is formed on the surface of each photosensitive drum 3. Each electrostatic latent image is visualized by a toner (developing agent) carried on the developing roller 5 corresponding to each photosensitive drum 3, and a toner image (developing agent image) is formed on the surface of the photosensitive drum 3. At this time, a developing bias (described later) is applied to the developing roller 5.

Sheets P are accommodated in a sheet supply cassette 8 arranged on a lower portion in the main body casing 2. Each sheet P accommodated in the sheet supply cassette 8 is transported to a transport belt 9 with various rollers provided in the vicinity of the front end portion of the sheet supply cassette 8, while the direction thereof is changed rearward from the front side. The transport belt 9 is arranged between the photosensitive drums 3K, 3C, 3M and 3Y and four transfer rollers 10 provided in response to the four photosensitive drums 3 respectively and opposed to the corresponding photosensitive drums 3 from below. The toner images formed on the surfaces of the photosensitive drums 3 are successively transferred and overlaid one the other on the sheet P transported to the transport belt 9 with transfer biases applied to the transfer rollers 10.

The sheet P having the toner images of the four colors transferred thereto is transported to a fixing section 11. The toner images transferred onto the sheet P are thermally fixed in the fixing section 11. Thereafter the sheet P is ejected to a sheet ejecting tray 12 provided on an upper portion of the main body casing 2 with various rollers, while the direction thereof is changed frontward from the rear side.

In such image formation, the cleaning brushes 6 capture foreign matter such as residual toners and sheet dust remaining on the photosensitive drums 3 after the transfer of the toner images onto the sheet P.

Drum Unit

The printer 1 includes a drum unit 13 as an example of a photosensitive unit configured to be mounted in and dismounted from the main body casing 2 in a state integrally holding the aforementioned photosensitive drums 3, the chargers 4, the developing rollers 5 and the cleaning brushes 6.

The drum unit 13 is slid along the anteroposterior direction from the front side to be mounted in or dismounted from the main body casing 2, and accommodated in an accommodation chamber 50 (described later) formed in the main body casing 2 when the drum unit 13 is mounted in the main body casing 2. The position of the drum unit 13 accommodated in the accommodation chamber 50 is referred to as an accommodated position (see FIGS. 11A to 14 described later). On the other hand, the position of the drum unit 13 shown in FIGS. 2 to 6 is referred to as a drawn position, where the drum unit 13 is drawn from the accommodation chamber 50.

In the following description, the front side in the anteroposterior direction is regarded as the upstream side a direction in which the drum unit 13 is mounted with respect to the main casing 2 (hereinafter referred to as a mounting direction of the drum unit 13) while the rear side is regarded as the downstream side in the mounting direction of the drum unit 13.

While the drum unit 13 is slid along the anteroposterior direction when the same is mounted in or dismounted from the main body casing 2, while an orthogonal direction orthogonal to this sliding direction is regarded as the width direction.

As shown in FIG. 1, the drum unit 13 includes a boxy unit casing 14 having open upper and lower surfaces (see FIGS. 3 and 6), and the unit casing 14 includes four subunits 15 correspondingly to the four photosensitive drums 3. In the following description, the four subunits 15 are classified into subunits 15K, 15C, 15M and 15Y in response to the colors of the toners respectively, similarly to the photosensitive drums 3. These subunits 15 are arranged in line along the anteroposterior direction in the main body casing 2, similarly to the aforementioned four photosensitive drums 3. More specifically, these subunits 15 are arranged in the order of the subunits 15K, 15C, 15M and 15Y from the rear side.

(1) Unit Casing

Figure 6:
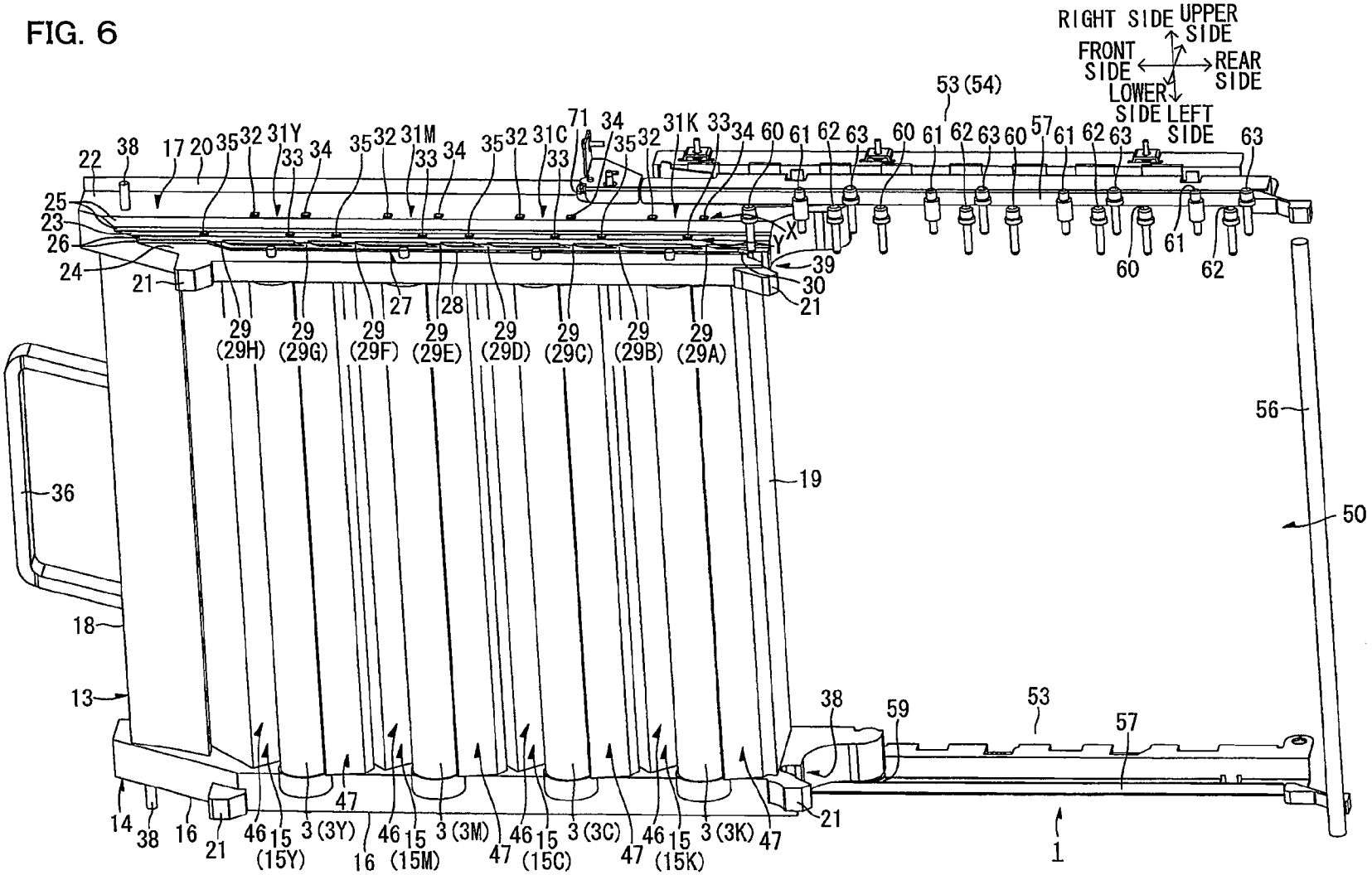
FIG. 6 is a perspective view of the principal part of the printer in the state shown in FIG. 2 as viewed from below.

As shown in FIG. 6, the unit casing 14 integrally includes a left wall 16, a right wall 17, a front-side wall 18 and a rear-side wall 19.

Figure 3:
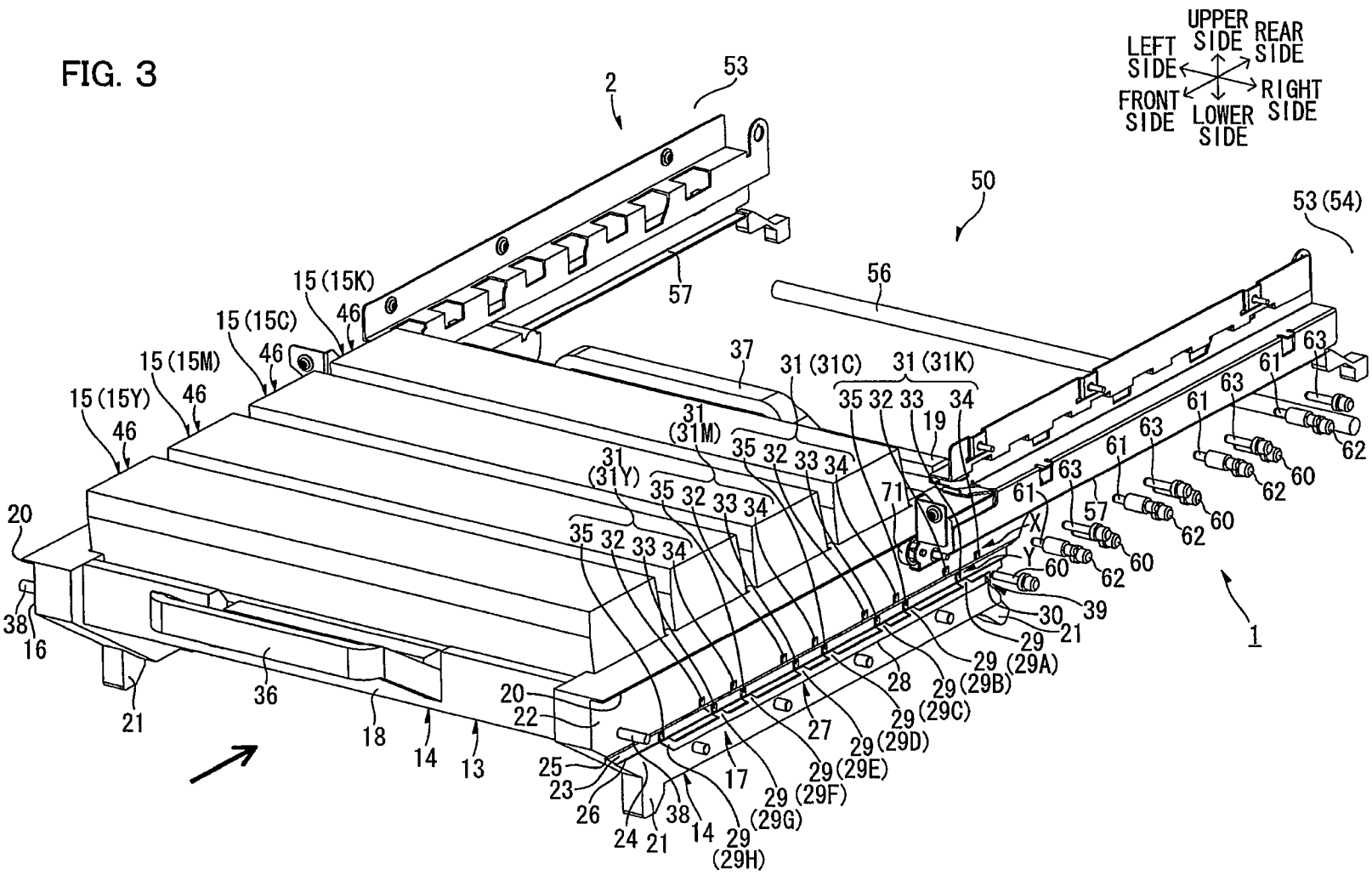
FIG. 3 is a perspective view of a principal part of the printer in the state shown in FIG. 2 as viewed from above.

The left and right walls 16 and 17, which are similar to each other, are in the form of plates elongated in the anteroposterior direction and thin in the width direction, and opposed to each other at an interval in the width direction (see also FIG. 3). More specifically, the upper and lower edges of the left and right walls 16 and 17 extend along the anteroposterior direction, and most parts of the front edges extend obliquely upward on the front side while the rear edges are bent in the form of arcs swelling out frontward (see FIG. 4). Notches 39 bent frontward are formed in the vicinity of the lower end portions of the rear edges of the left and right walls 16 and 17 respectively (see FIG. 4).

As shown in FIG. 3, the left and right walls 16 and 17 are integrally provided with flange portions 20 extending outward in the width direction continuously from the upper edges respectively. The flange portions 20 are in the form of vertically thin plates flatly extending along the anteroposterior direction.

On the rear end portion of each of the left and right walls 16 and 17, rollers 59 (FIG. 13) are rotatably provided in the vicinity of the rear end portion of the corresponding flange portion 20.

In each of the left and right walls 16 and 17, downwardly protruding convexes 21 are integrally provided on the front and rear ends of the lower end portion. When the drum unit 13 is dismounted from the main body casing 2 and placed on the floor, the convexes 21 come into contact with the floor.

On the right side surface of the right wall 17, a region below the flange portion 20 is divided into an upper right surface 22 as an example of a second outer side surface, a middle right surface 23 as an example of a first outer side surface and a lower right surface 24 as an example of a third outer side surface successively from the upper side. It is understood that the lower right surface 24 is opposite to the upper right surface 22 with respect to the middle right surface 23.

Figure 5:
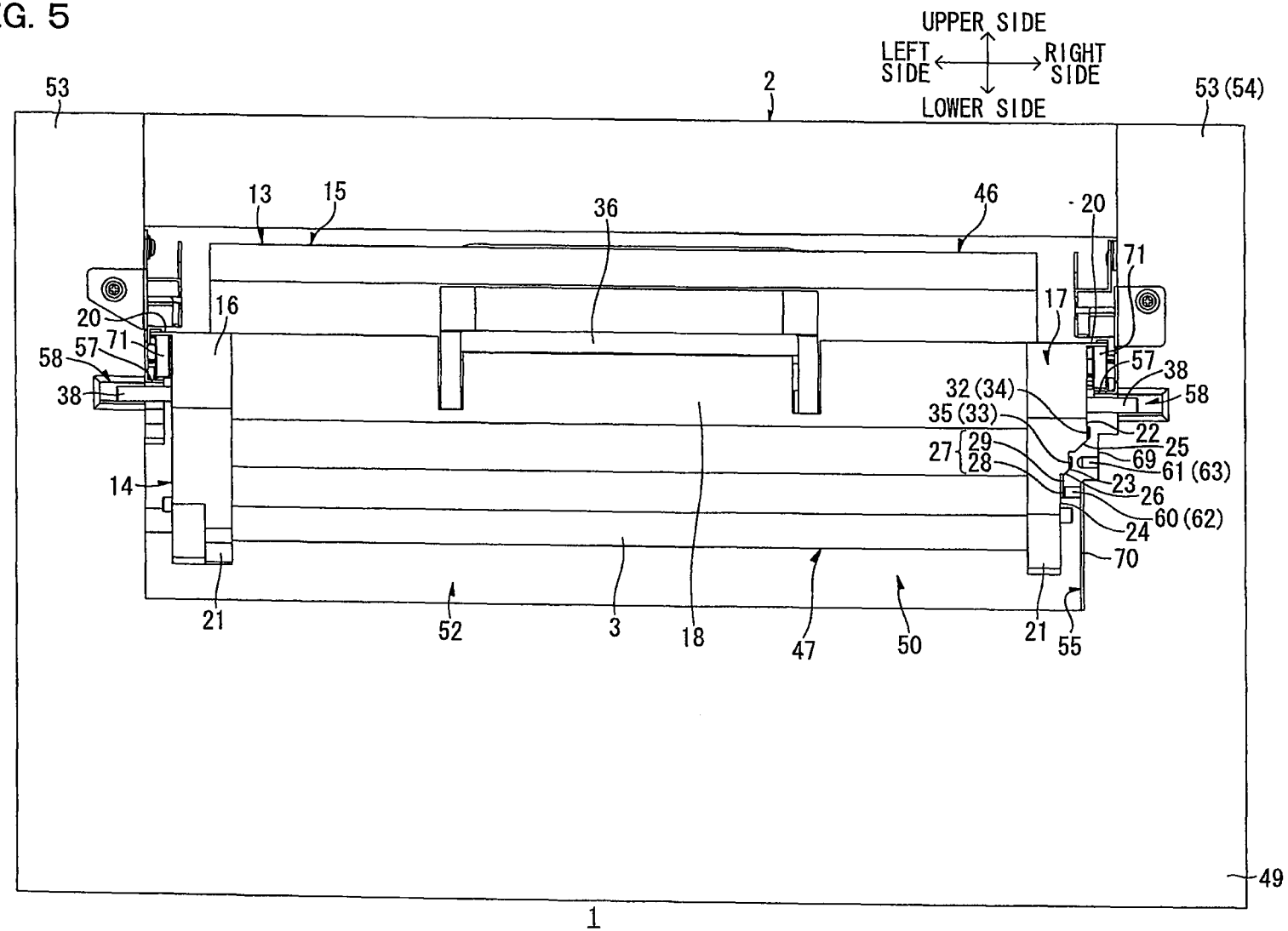
FIG. 5 is a front elevational view of the printer in the state shown in FIG. 2.

The upper, middle and lower right surfaces 22, 23 and 24 are elongated in the anteroposterior direction, extend along the anteroposterior and vertical directions, and are flat as viewed from both of the anteroposterior and vertical directions (in other words, not irregular in the width direction), as shown in FIG. 5. As to the vertical dimensions, the upper right surface 22 is slightly larger than the lower right surface 24, and the middle right surface 23 is the smallest (see FIG. 2).

The middle right surface 23 is arranged leftward beyond the upper right surface 22, and the lower right surface 24 is arranged leftward beyond the middle right surface 23. In other words, the upper right surface 22 protrudes outward (rightward) beyond the middle right surface 23 in the width direction, while the middle right surface 23 protrudes rightward beyond the lower right surface 24. Therefore, the right side surface of the right wall 17 is concaved stepwise leftward toward the lower side.

The lower edge of the upper right surface 22 and the upper edge of the middle right surface 23 are coupled with each other by a first coupling surface 25 slightly extending rightward continuously from the upper edge of the middle right surface 23 and thereafter extending obliquely upward on the right side to be connected to the lower edge of the upper right surface 22. The lower edge of the middle right surface 23 and the upper edge of the lower right surface 24 are coupled with each other by a second coupling surface 26 slightly extending rightward continuously from the upper edge of the lower right surface 24 and thereafter extending obliquely upward on the right side to be connected to the lower edge of the middle right surface 23.

As shown in FIG. 3, the lower right surface 24 is integrally provided with a rightwardly protruding rib 27. The rib 27 includes a first rib 28 extending along the anteroposterior direction and eight second ribs 29 extending obliquely upward on the front side continuously from the upper edge of the first rib 28. Most part of the right side surface of the rib 27 is flatly formed, similarly to the lower right surface 24. However, the rear end portion of the right side surface of the first rib 28 is inclined obliquely rearward on the left side and continuous with the lower right surface 24, to form an inclined surface 30. In other words, the inclined surface 30 swells out rightward from the downstream side (rear side) toward the upstream side (front side) in the mounting direction (see thick arrow in FIG. 3) of the drum unit 13 with respect to the main body casing 2. A portion of the right side surface of the first rib 28 excluding the inclined surface 30 and the right side surfaces of the second ribs 29 are flush with one another.

The eight second ribs 29 are arranged at intervals in the anteroposterior direction. The eight second ribs 29 are classified into second ribs 29A, 29B, 29C, 29D, 29E, 29F, 29G and 29H successively from the rear side.

The second rib 29A extends from a portion close to the inclined surface 30 of the first rib 28, while the second rib 29H extends from the front end portion of the first rib 28. The second rib 29B is closer to the second rib 29C than the second rib 29A, while the second rib 29C is closer to the second rib 29B than the second rib 29D. The second rib 29D is closer to the second rib 29E than the second rib 29C, while the second rib 29E is closer to the second rib 29D than the second rib 29F. The second rib 29F is closer to the second rib 29G than the second rib 29E, while the second rib 29G is closer to the second rib 29F than the second rib 29H.

More specifically, the intervals between the second ribs 29B and 29C, between the second ribs 29D and 29E and between the second ribs 29F and 29G are equal to one another. Further, the intervals between the second ribs 29A and 29B, between the second ribs 29C and 29D, between the second ribs 29E and 29F and between the second ribs 29G and 29H are equal to one another, and these intervals are wider than the interval between the second ribs 29B and 29C.

As shown in FIGS. 5 and 6, the upper end of the right side surface (excluding the inclined surface 30) of the first rib 28 and the lower end of the right side surface of each second rib 29 are continuous with each other, and the upper end of the right side surface of each second rib 29 is continuous with the aforementioned second coupling surface 26 (more specifically, the portion extending obliquely upward on the right side) from below.

On the right side surface of the right wall 17, four electrode groups 31 are arranged correspondingly to the aforementioned four subunits 15K, 15C, 15M and 15Y respectively, as shown in FIG. 3. The four electrode groups 31 are classified into electrode groups 31K, 31C, 31M and 31Y successively from the rear side, correspondingly to the subunits 15K, 15C, 15M and 15Y respectively.

Each electrode group 31 is constituted of four electrodes, i.e., a wire electrode 32, a grid electrode 33, a cleaning electrode 34 and a developing roller electrode 35. The grid electrode 33 and the developing roller electrode 35 function as examples of a first electrode, while the wire electrode 32 and the cleaning electrode 34 function as examples of a second electrode.

Figure 4:
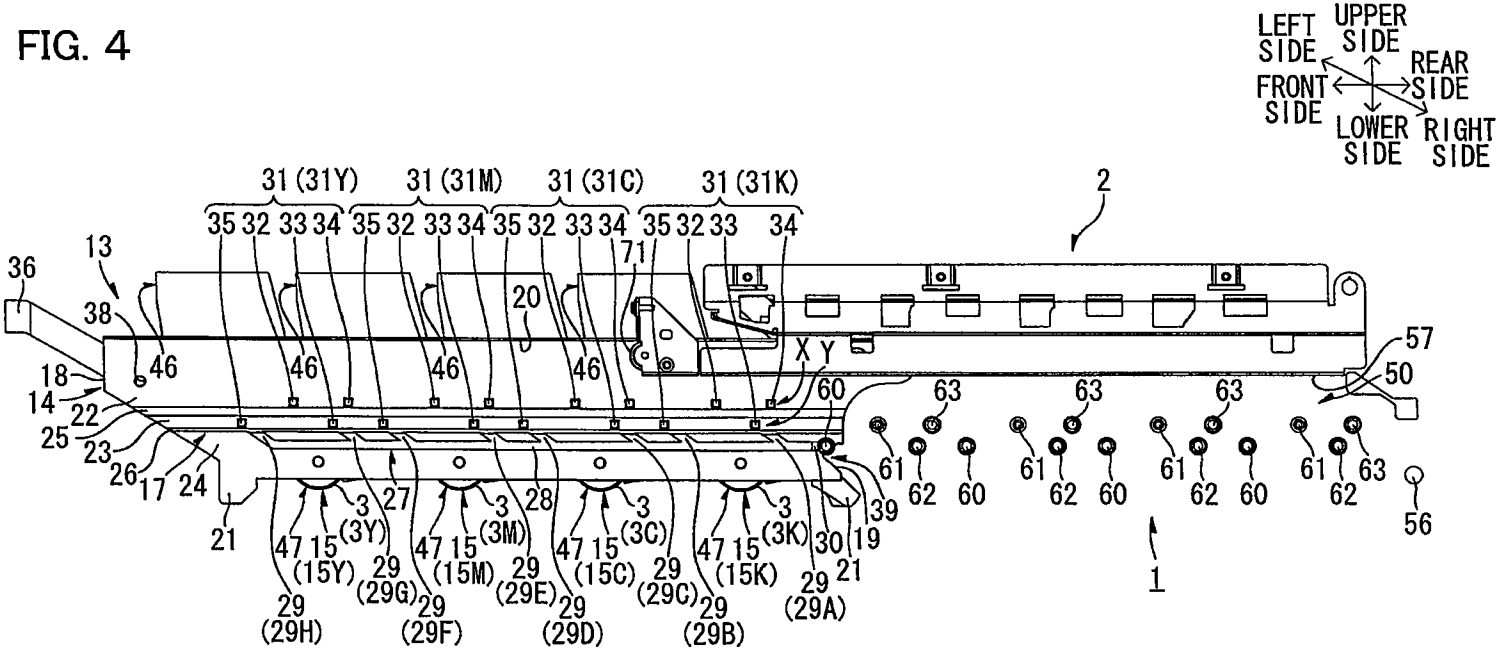
FIG. 4 is a right side elevational view of the principal part of the printer in the state shown in FIG. 2.

In each electrode group 31, the wire electrode 32 and the cleaning electrode 34 are so disposed as to align with each other in the anteroposterior direction along the lower edge of the upper right surface 22, as shown in FIG. 4. More specifically, the wire electrode 32 is disposed in front of the cleaning electrode 34 at an interval. The right side surfaces of the wire electrode 32 and the cleaning electrode 34 are generally flush with the upper right surface 22, or slightly protrude rightward from the upper right surface 22 (see FIG. 5).

On the other hand, the grid electrode 33 and the developing roller electrode 35 are so disposed as to align with each other in the anteroposterior direction along the lower edge of the middle right surface 23. More specifically, the developing roller electrode 35 is disposed in front of the grid electrode 33 at an interval. The right side surfaces of the grid electrode 33 and the developing roller electrode 35 are generally flush with the middle right surface 23, or slightly protrude rightward from the middle right surface 23 (see FIG. 5).

The grid electrode 33 and the developing roller electrode 35 are adjacent to the upper end portions of the corresponding second ribs 29 respectively. In other words, in the electrode group 31K, the grid electrode 33 is adjacent to the upper end portion of the second rib 29A and the developing roller electrode 35 is adjacent to the upper end portion of the second rib 29B. Similarly, in the electrode group 31C, the grid electrode 33 is adjacent to the upper end portion of the second rib 29C and the developing roller electrode 35 is adjacent to the upper end portion of the second rib 29D. In the electrode group 31M, the grid electrode 33 is adjacent to the upper end portion of the second rib 29E, and the developing roller electrode 35 is adjacent to the upper end portion of the second rib 29F. In the electrode group 31Y, the grid electrode 33 is adjacent to the upper end portion of the second rib 29G, and the developing roller electrode 35 is adjacent to the upper end portion of the second rib 29H.

As to the positions of the electrodes in each electrode group 31 in the anteroposterior direction, the grid electrode 33 is positioned between the wire electrode 32 and the cleaning electrode 34, while the developing roller electrode 35 is positioned frontward beyond the wire electrode 32.

When the four electrode groups 31 are collectively observed, all wire electrodes 32 and cleaning electrodes 34 are arranged on the same straight line extending along the anteroposterior direction to form a train X on the upper right surface 22, and alternately arranged in this train X. On the other hand, all grid electrodes 33 and developing roller electrodes 35 are arranged on the same straight line extending along the anteroposterior direction to form a train Y on the middle right surface 23, and alternately arranged in this train Y.

More specifically, all wire electrodes 32 and cleaning electrodes 34, and, all grid electrodes 33 and developing roller electrodes 35, are parallelly arranged at an interval in the vertical direction, so that the train X of the wire electrodes 32 and the cleaning electrodes 34 is arranged above and the train Y of the grid electrodes 33 and the developing roller electrodes 35 is arranged below.

As shown in FIGS. 3 and 6, the front-side wall 18 is extended between the front edges of the left and right walls 16 and 17, while the rear-sidewall 19 is extended between the rear edges of the left and right walls 16 and 17.

As shown in FIG. 3, a first handle 36 is provided at the center of the front-side wall 18 in the width direction, while a second handle 37 is provided at the center of the rear-side wall 19 in the width direction.

The first handle 36 generally has an inverted U shape having two free end portions, which are supported on the front-side wall 18. More specifically, a support shaft 38 extending in the width direction is inserted into the front-side wall 18, and this support shaft 38 is inserted also into the two free end portions of the first handle 36. Therefore, the first handle 36 is swingable on the support shaft 38 between an upright position (not shown) where the first handle 36 is uprighted along the front-side wall 18 and a tilted position (see FIG. 3) tilted frontward from the front-side wall 18. Both end portions of the support shaft 38 in the width direction protrude outward from the unit casing 14 in the width direction.

The second handle 37 also generally has an inverted U shape having two free end portions, which are connected to the rear-side wall 19.

The first and second handles 36 and 37 are grasped when the drum unit 13 is mounted in or dismounted from the main body casing 2.

(2) Subunit

As shown in FIG. 1, each subunit 15 is a hollow body inclined obliquely upward on the front side with respect to a horizontal plane (including the anteroposterior and right-and-left directions), and has the aforementioned photosensitive drum 3, the charger 4, the developing roller 5, the cleaning brush 6, a toner accommodation chamber 40, an agitator 41, a feed roller 42 and a layer-thickness regulating blade 43 therein.

The toner accommodation chamber 40, generally forming the upper half of the subunit 15, accommodates the toner of the color corresponding to each subunit 15. The feed roller 42 is arranged under the toner accommodation chamber 40, to come into contact with the developing roller 5 from above.

The developing roller 5 is in contact with the photosensitive drum 3 from the front side. The developing roller electrode 35 (see FIG. 3) of the corresponding electrode group 31 is connected to the developing roller 5. In image formation, a developing roller contact 60 (see FIG. 3), described later, provided in the main body casing 2 applies the developing bias to the developing roller 5 through the developing roller electrode 35.

The toner accommodated in the toner accommodation chamber 40 is agitated by the agitator 41, fed to the feed roller 42 by the own weight thereof, formed as a thin layer, carried by the developing roller 5 as hereinabove described, to contribute to visualization of the electrostatic latent image formed on the corresponding photosensitive drum 3. The layer-thickness regulating blade 43 regulates the thin layer of the toner carried by the developing roller 5 to a prescribed thickness.

The charger 4 is opposed to the photosensitive drum 3 at an interval at the back of the photosensitive drum 3 on the oblique upper side. The charger 4 includes a discharge wire 44 opposed to the photosensitive drum 3 at an interval and a grid 45 provided between the discharge wire 44 and the photosensitive drum 3.

The wire electrode 32 (see FIG. 3) of the corresponding electrode group 31 is connected to the discharge wire 44, while the grid electrode 33 (see FIG. 3) is connected to the grid 45.

In the charger 4, a wire contact 61 (see FIG. 3), described later, provided in the main body casing 2 applies a discharge voltage to the discharge wire 44 through the wire electrode 32 in image formation, thereby corona-discharging the discharge wire 44. At the same time, a grid contact 62 (see FIG. 3), described later, provided in the main body casing 2, applies a grid voltage to the grid 45 through the grid electrode 33 to control the amount of electric charge fed to the photosensitive drum 3, whereby the surface of the photosensitive drum 3 is uniformly charged, as hereinabove described.

The cleaning brush 6 is opposed to and in contact with the photosensitive drum 3 at the back of the photosensitive drum 3. The cleaning electrode 34 (see FIG. 3) of the corresponding electrode group 31 is connected to the cleaning brush 6. In image formation, a cleaning contact 63 (see FIG. 3), described later, provided in the main body casing 2 applies a cleaning bias to the cleaning brush 6 through the cleaning electrode 34. The cleaning brush 6 captures the aforementioned foreign matter present on the photosensitive drum 3 with this cleaning bias.

Each subunit 15 can be separated into a first subunit 46 as an example of a first process member and a second subunit 47 as an example of a second process member. The first subunit 46, forming the upper portion of the subunit 15, has the developing roller 5, the toner accommodation chamber 40, the agitator 41, the feed roller 42 and the layer-thickness regulating blade 43. The second subunit 47, forming the lower portion of the subunit 15, has the photosensitive drum 3, the charger 4 and the cleaning brush 6. As hereinabove described, the electrostatic latent image formed on the corresponding photosensitive drum 3 is visualized by the functions of the individual components in the subunit 15. Therefore, it is understood that the first and second subunits 46 and 47 contribute to the visualization of the electrostatic latent image formed on the photosensitive drum 3 respectively, even if the subunit 15 is separated into a first subunit 46 and a second subunit 47.

In this case, in the first subunit 46, the developing roller electrode 35 is connected to the developing roller contact 60 (see FIG. 3), whereby power (developing bias) is fed from the developing roller contact 60 to the developing roller 5 through the developing roller electrode 35.

In the second subunit 47, the wire electrode 32 is connected to the wire contact 61 (see FIG. 3), whereby power is fed from the wire contact 61 to the discharge wire 44 through the wire electrode 32. Further, the grid electrode 33 is connected to the grid contact 62 (see FIG. 3), whereby power (grid voltage) is fed from the grid contact 62 to the grid 45 through the grid electrode 33. The cleaning electrode 34 is connected to the cleaning contact 63 (see FIG. 3), whereby power (cleaning bias) is fed from the cleaning contact 63 to the cleaning brush 6 through the cleaning electrode 34.

While the second subunit 47 is fixed to the unit casing 14, the first subunit 46 may be rendered mountable in and dismountable from the unit casing 14.

Main Body Casing

As shown in FIG. 1, a front cover 51 is provided on a front wall 49 of the main body casing 2. The lower end portion of the front cover 51 is supported by a hinge or the like on the front wall 49. Therefore, the front cover 51 is swingable on the lower end portion between a closed position (see FIG. 1) where the upper end portion thereof comes into contact with the upper wall of the main body casing 2 and an open position (not shown) where the upper end portion separates from the upper wall of the main body casing 2. FIGS. 2 to 14 omit illustration of the front cover 51.

When the front cover 51 is swung to the open position, a mounting port 52, generally rectangular in front elevational view, formed on the front wall 49 is released to expose the aforementioned accommodation chamber 50 frontward, as shown in FIG. 5. On portions forming the right and left edges of the mounting port 52 in the front wall 49, recesses 58 dented rearward are formed at the same positions in the vertical direction respectively.

Figure 7A:
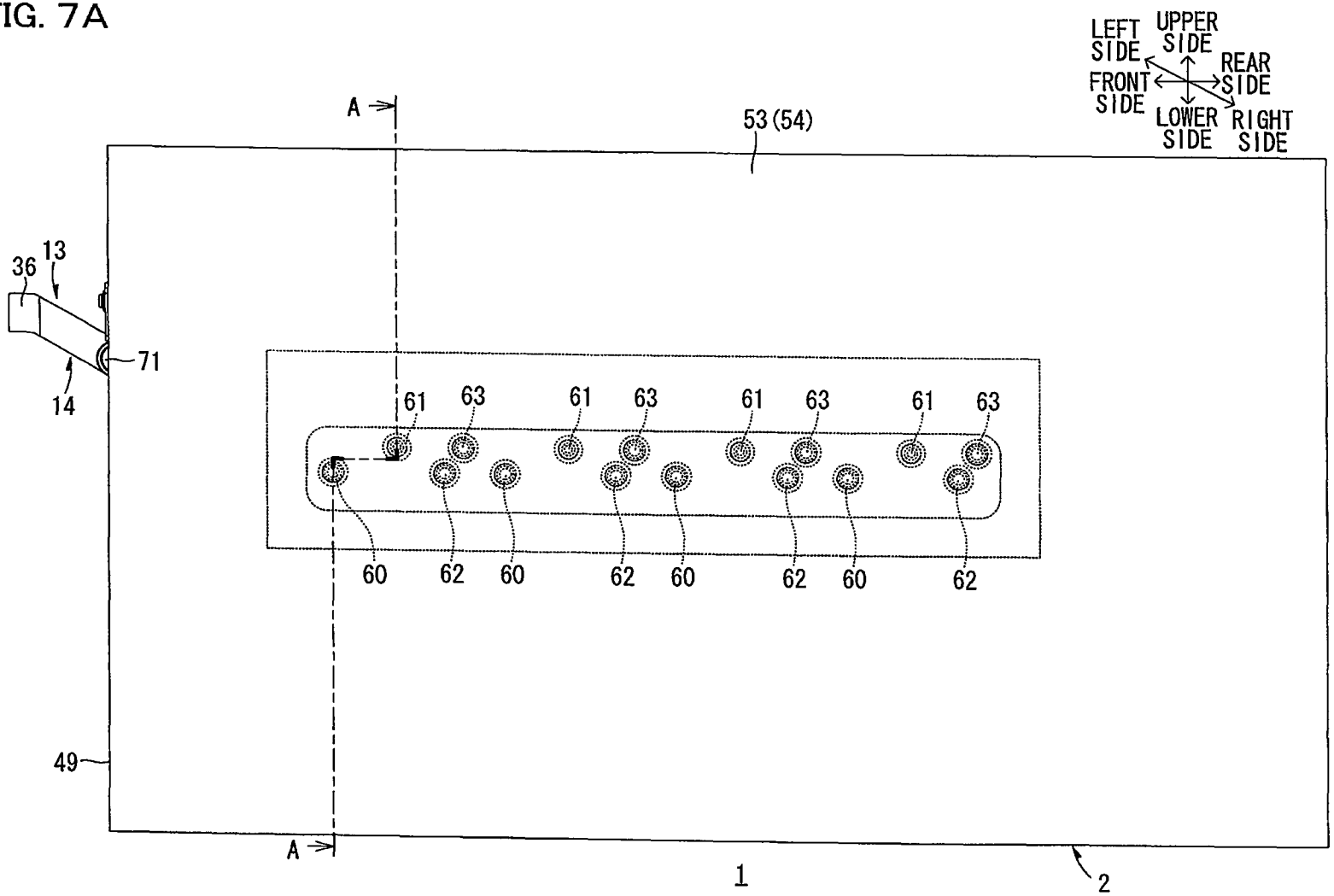
FIG. 7A is a right side elevational view of the printer in a state where the drum unit is located between an accommodated position and the drawn position.
Figure 7B:
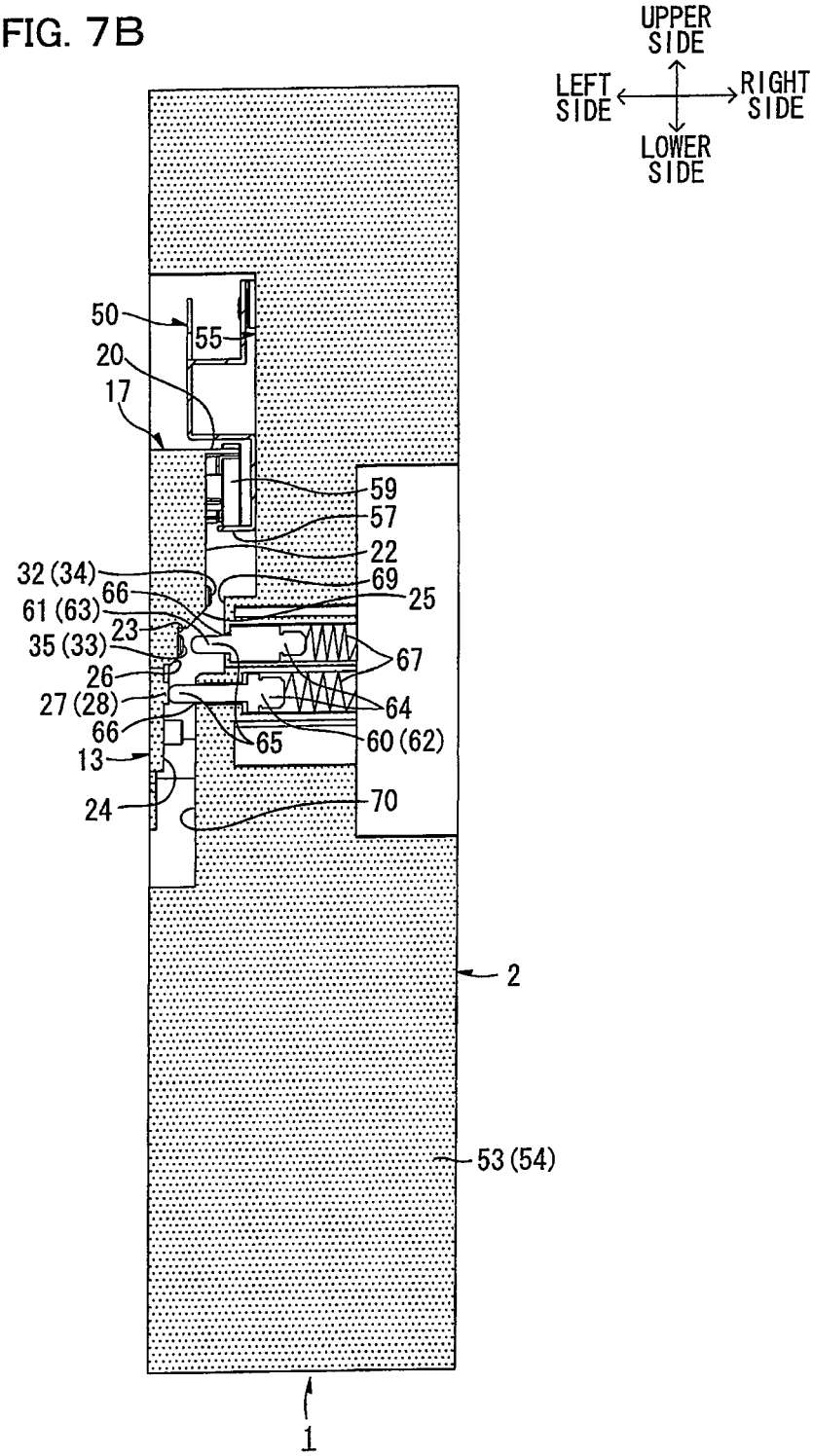
FIG. 7B is a partially fragmented sectional view of the printer taken along the line A-A in FIG. 7A.

The main body casing 2 includes a pair of side walls 53 opposed to each other at an interval in the width direction to hold the accommodation chamber 50 therebetween. FIG. 7B shows the right side wall 53 (right wall 54) in the pair of side walls 53. In the right wall 54, a left surface 55 which is an example of an inner side surface partitions the right side of the accommodation chamber 50. The aforementioned front wall 49 is extended between the front end portions of the pair of side walls 53 (see FIG. 5).

As shown in FIG. 3, a reference shaft 56 extending in the width direction is provided in the rear end portion (end portion on the downstream side in the mounting direction of the drum unit 13) of the accommodation chamber 50 in the main body casing 2. The reference shaft 56 is extended between the pair of side walls 53.

In the pair of side walls 53, guide rails 57 are provided at positions opposed to each other in the width direction respectively above the aforementioned recesses 58 (see FIG. 5). The guide rails 57 are so formed as to extend along the anteroposterior direction on the inner side surfaces of the corresponding side walls 53 in the width direction. In the guide rails 57, the corresponding flange portions 20 of the drum unit 13 are slidably received, while the rollers 59 (see FIG. 8) of the drum unit 13 are rolled therein. Rollers 71 are rotatably provided on the upper sides of the front end portions of the guide rails 57.

As shown in FIG. 5, on the left surface 55 of the right wall 54, a region below the corresponding guide rail 57 is divided into an upper left surface 69 as an example of a first inner side surface and a lower left surface 70 as an example of a second inner side surface successively from the upper side. The upper and lower left surfaces 69 and 70 are elongated in the anteroposterior direction, extend along the anteroposterior and vertical directions, and are flat as viewed from both of the anteroposterior and vertical directions (in other words, not irregular in the width direction). As to the vertical dimensions, the upper left surface 69 is smaller than the lower left surface 70. The upper left surface 69 is arranged leftward beyond the portion where the guide rail 57 is arranged on the left surface 55, while the lower left surface 70 is arranged leftward beyond the upper left surface 69. In other words, the lower left surface 70 protrudes inward (leftward) beyond the upper left surface 69 in the width direction, while the upper left surface 69 protrudes inward beyond the portion where the guide rail 57 is arranged on the left surface 55. Therefore, the left surface 55 protrudes stepwise leftward toward the lower side.

The right wall 54 is provided with (stores) four developing roller contacts 60, four wire contacts 61, four grid contacts 62 and four cleaning contacts 63 correspondingly to the electrode groups 31 of the drum unit 13 respectively, as shown in FIG. 3. The wire contacts 61 and the cleaning contacts 63 function as examples of a third electrode, while the grid contacts 62 and the developing roller contacts 60 function as examples of a fourth electrode. The developing roller contacts 60, the wire contacts 61 and the cleaning contacts 63 also function as examples of electrodes of the main body of the image forming apparatus.

The developing roller contact 60, the wire contact 61, the grid contact 62 and the cleaning contact 63 are disposed to be opposed to the corresponding developing roller electrode 35, corresponding wire electrode 32, corresponding grid electrode 33 and cleaning electrode 34 of each electrode group 31 respectively in the width direction when the drum unit 13 is mounted in the main body casing 2.

More specifically, the wire contacts 61 and the cleaning contacts 63 are disposed on the upper left surface 69 (see FIG. 5), and alternately arranged on the same straight line extending along the anteroposterior direction. On the other hand, the grid contacts 62 and the developing roller contacts 60 are provided on the lower left surface 70 (see FIG. 5), and alternately arranged on the same straight line extending along the anteroposterior direction. In other words, the wire contacts 61 and the cleaning contacts 63, and, the grid contacts 62 and the developing roller contacts 60, are parallelly arranged at an interval from one another in the vertical direction.

Each of the developing roller contacts 60, the wire contacts 61, the grid contacts 62 and the cleaning contacts 63 integrally includes a large-diametral head portion 64 provided on the outer side (right side) in the width direction and a small-diametral shaft portion 65 extending inward (leftward) in the width direction from the head portion 64, as shown in each of the developing roller contact 60 and the wire contact 61 in FIG. 7B.

A plurality of contact holes 66 are formed on the left surface 55 of the right wall 54 in response to the number of the contacts, to project shaft portions 65 of the developing roller contacts 60, the wire contacts 61, the grid contacts 62 and the cleaning contacts 63 leftward (toward the accommodation chamber 50) from the left surface 55 respectively. The contact holes 66 corresponding to the wire contacts 61 and the cleaning contacts 63 are formed on the upper left surface 69, while the contact holes 66 corresponding to the grid contacts 62 and the developing roller contacts 60 are formed on the lower left surface 70.

The right wall 54 stores springs 67 engaging with the head portions 64 of the developing roller contacts 60, the wire contacts 61, the grid contacts 62 and the cleaning contacts 63 and urging the head portions 64 leftward. Thus, the developing roller contacts 60, the wire contacts 61, the grid contacts 62 and the cleaning contacts 63 are regularly urged leftward by the springs 67. Thus, while the shaft portions 65 of the contacts 60 to 63 protrude into the accommodation chamber 50 from the right wall 54 through the contact holes 66, the head portions 64 cannot move leftward beyond the contact holes 66, whereby the contacts 60 to 63 are kept in the state supported on the right wall 54 without displacement.

Mounting Drum Unit in Main Body Casing

When the front cover 51 (see FIG. 1) is swung to the open position, the accommodation chamber 50 is exposed from the mounting port 52 of the main body casing 2 (see FIG. 5). Thereafter the first handle 36 of the drum unit 13 located at the drawn position (see also FIGS. 2 to 6) is grasped to push the drum unit 13 rearward, thereby inserting the drum unit 13 into the accommodation chamber 50 rearward from the front side along the anteroposterior direction.

In order to insert the drum unit 13 into the accommodation chamber 50, the rollers 59 (see FIG. 8) provided on the rear end portion of the drum unit 13 are rolled on the corresponding guide rails 57 in the accommodation chamber 50 while the flange portions 20 are slid on the rollers 71 of the corresponding guide rails 57, as shown in FIG. 3.

When the drum unit 13 is inserted into the accommodation chamber 50, the rear end portion of the right side surface (the upper, middle and lower right surfaces 22, 23 and 24) of the unit casing 14 of the drum unit 13 starts to be opposed to the left surface 55 of the right wall 54 partitioning the right side of the accommodation chamber 50 in the width direction (see FIG. 5).

When the drum unit 13 is continuously inserted, the headmost developing roller contact 60 is opposed to the lower right surface 24 in the width direction, extends onto the inclined surface 30 of the first rib 28 of the lower right surface 24, and moves rightward against the urging force of the corresponding spring 67 (see FIG. 7B), as shown in FIGS. 4 and 5. Then, the headmost wire contact 61 is opposed to the middle right surface 23 at an interval from the right side. More specifically, the wire contact 61 is opposed to the corresponding grid electrode 33 and the corresponding developing roller electrode 35 provided on the middle right surface 23 at an interval in the width direction, as viewed from the anteroposterior direction (see FIG. 5). In other words, the headmost wire contact 61, not in contact with the drum unit 13 at this time, is kept at the same width-directional position as that before the insertion of the drum unit 13 into the accommodation chamber 50.

When the drum unit 13 is further inserted, the headmost developing roller contact 60 relatively moves frontward with respect to the drum unit 13, and slides with respect to the right side surface of the first rib 28 at this time. The portion of the right side surface of the first rib 28 excluding the inclined surface 30 is flatly formed as hereinabove described, whereby the developing roller contact 60 sliding with respect to the right side surface of the first rib 28 is kept at a constant width-directional position. Then, the grid contact 62 positioned at the back of the developing roller contact 60 is opposed to the lower right surface 24 in the width direction and extends onto the inclined surface 30 of the first rib 28 similarly to the developing roller contact 60, and thereafter slides with respect to the right side surface of the first rib 28 while, the grid contact 62 is kept at a constant width-directional position.

At this time, the headmost wire contact 61, continuously opposed to the middle right surface 23 at an interval from the right side, relatively moves frontward with respect to the drum unit 13. Then, the cleaning contact 63 positioned at the back of the wire contact 61 is opposed to the middle right surface 23 from the right side at an interval, similarly to the wire contact 61. More specifically, the cleaning contact 63 is opposed to the corresponding grid electrode 33 and the corresponding developing roller electrode 35 provided on the middle right surface 23 at an interval in the width direction (see FIG. 5). Therefore, the cleaning contact 63 is kept at the same width-directional position as that before the drum unit 13 is inserted into the accommodation chamber 50. The cleaning contact 63, continuously opposed to the middle right surface 23 from the right side at an interval, relatively moves frontward with respect to the drum unit 13.

As the insertion of the drum unit 13 progresses, the remaining developing roller contacts 60 and grid contacts 62 are successively opposed to the lower right surface 24 in the width direction, extend onto the inclined surface 30 of the first rib 28, and thereafter slide with respect to the right side surface of the first rib 28 while the same are kept at constant width-directional positions, similarly to the above. Then, the remaining wire contacts 61 and cleaning contacts 63 are successively opposed to the middle right surface 23 from the right side at intervals, and thereafter relatively move frontward with respect to the drum unit 13 while maintaining this state.

Figure 8:
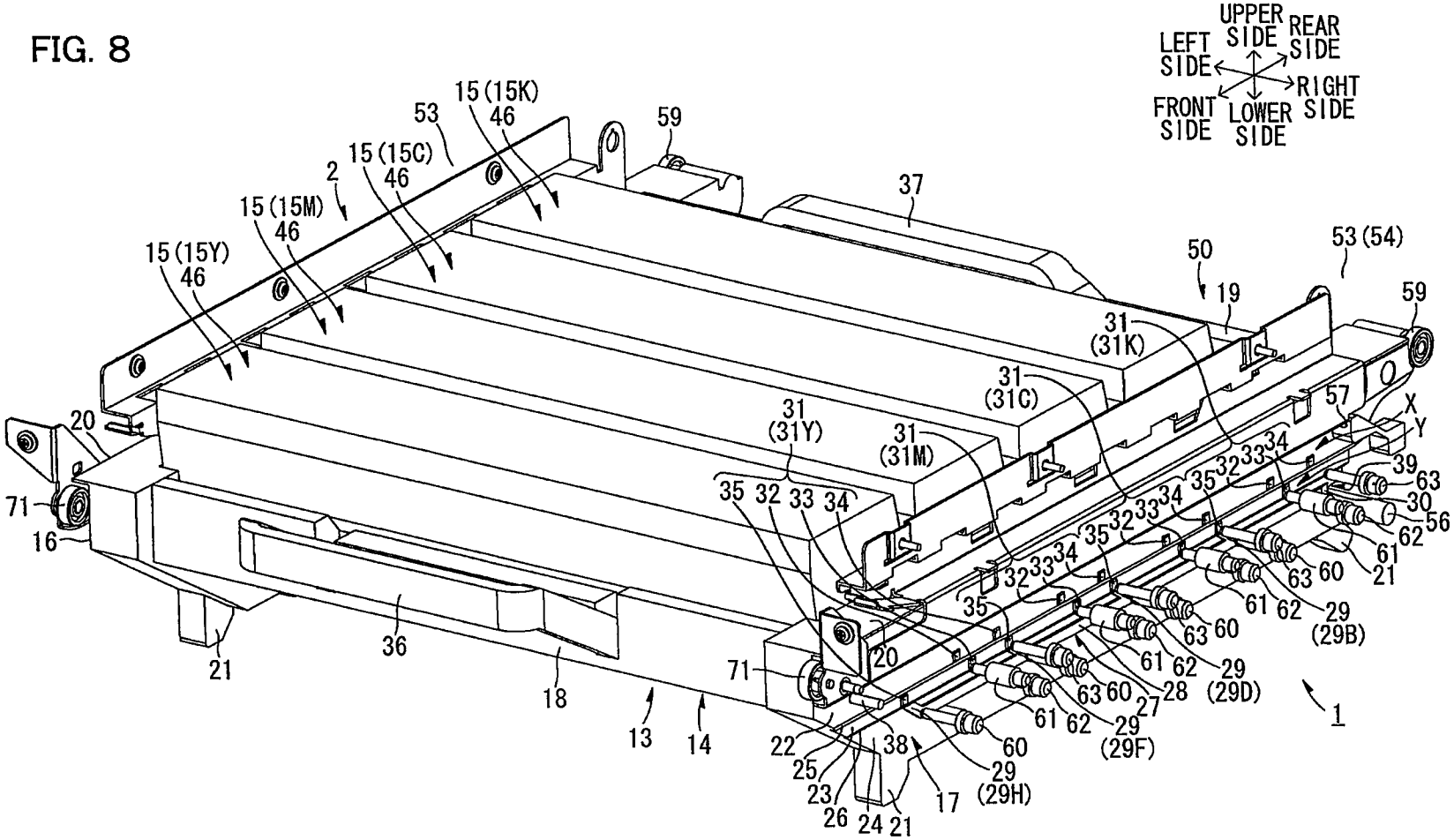
FIG. 8 is a perspective view of the principal part of the printer in the state shown in FIG. 7A as viewed from above.
Figure 9:
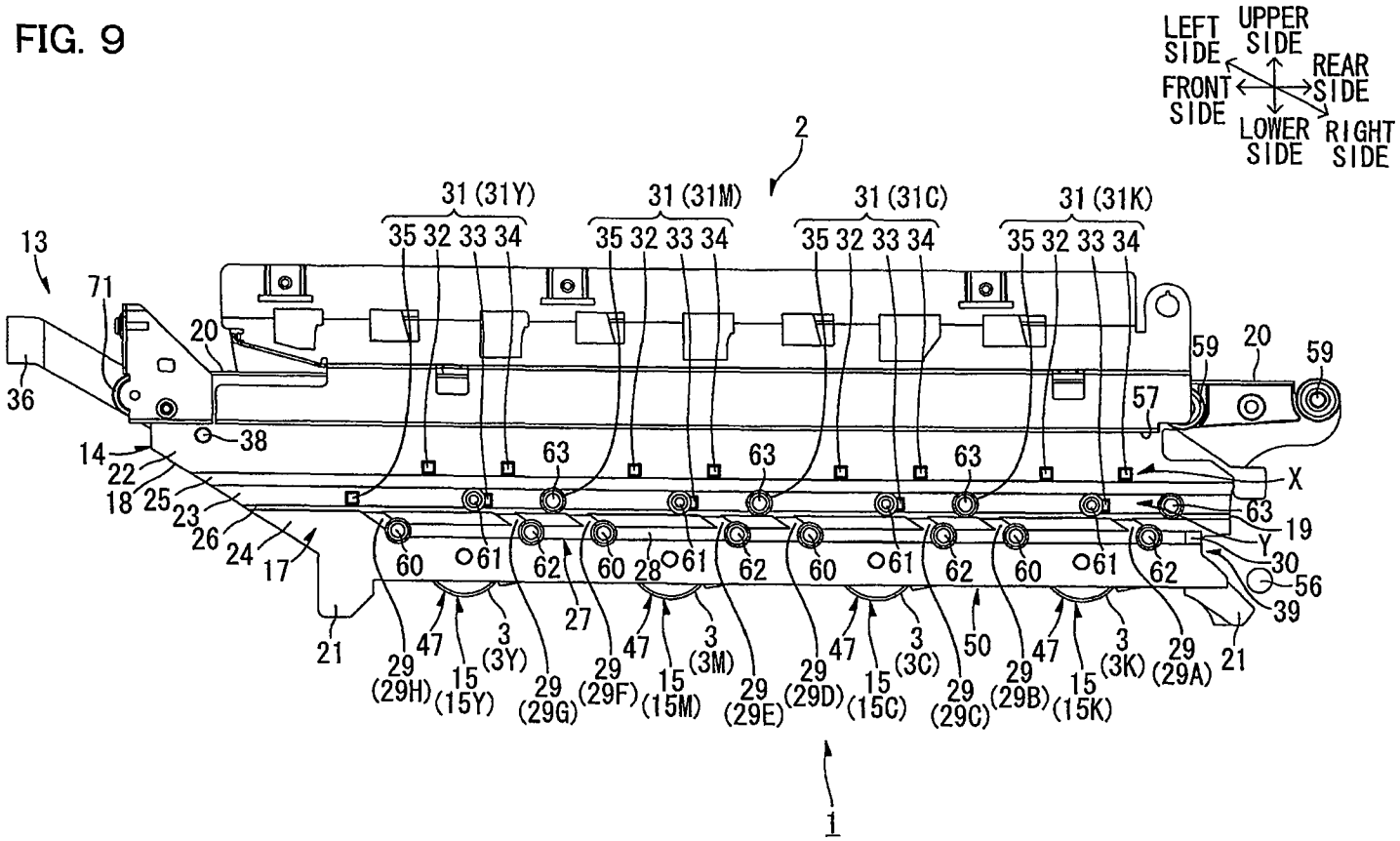
FIG. 9 is a right side elevational view of the principal part of the printer in the state shown in FIG. 7A.

As the insertion of the drum unit 13 further progresses, each of the developing roller contacts 60 and the grid contacts 62 approaches a position where the first rib 28 is branched into the corresponding second rib 29, as shown in FIGS. 8 and 9. In the drum unit 13, the rollers 59 project rearward from the guide rails 57 and the flange portions 20 are displaced from the rollers 71 of the guide rails 57 at this time.

Figure 12:
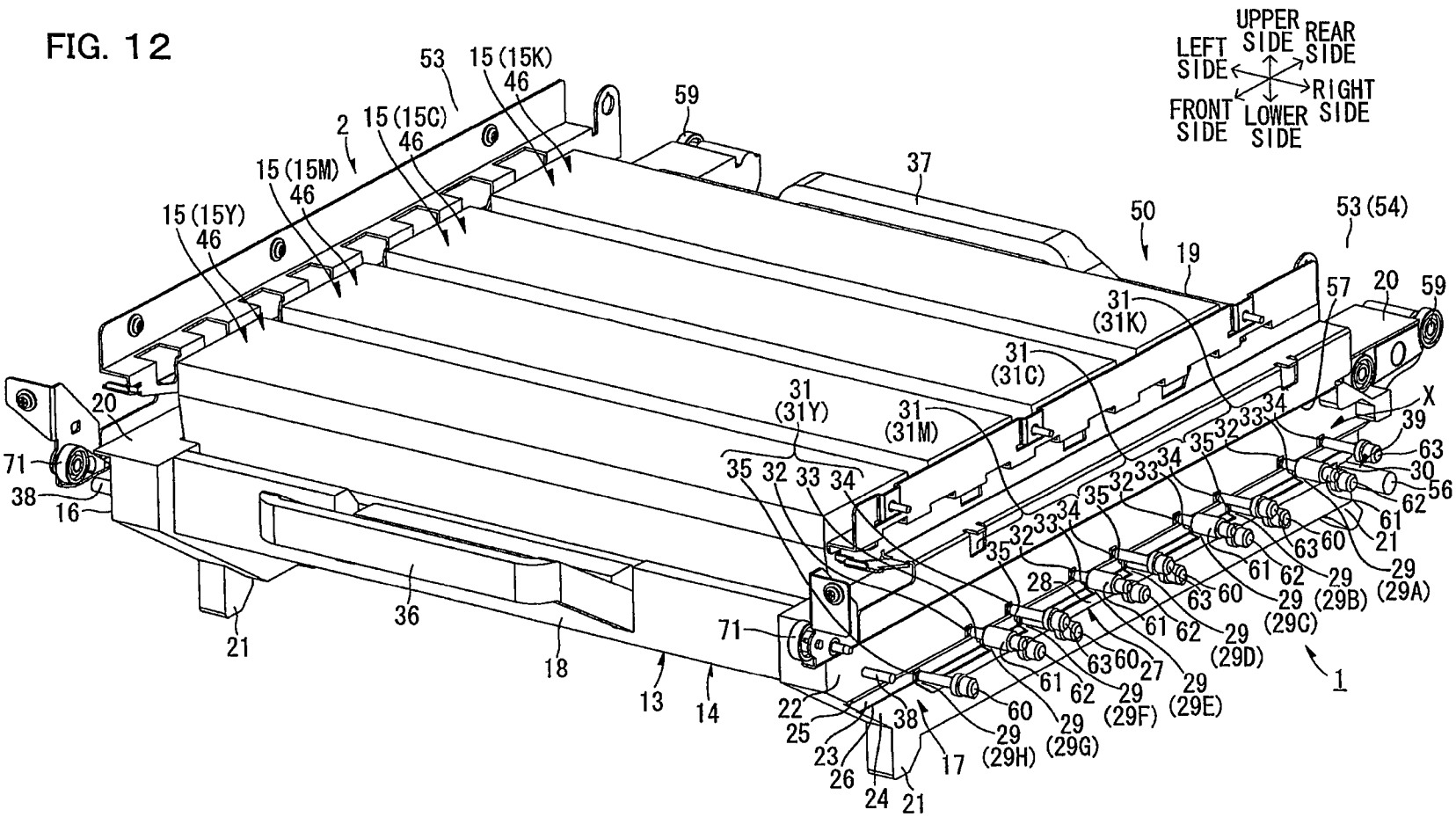
FIG. 12 is a perspective view of the principal part of the printer in the state shown in FIG. 11A as viewed from above.
Figure 13:
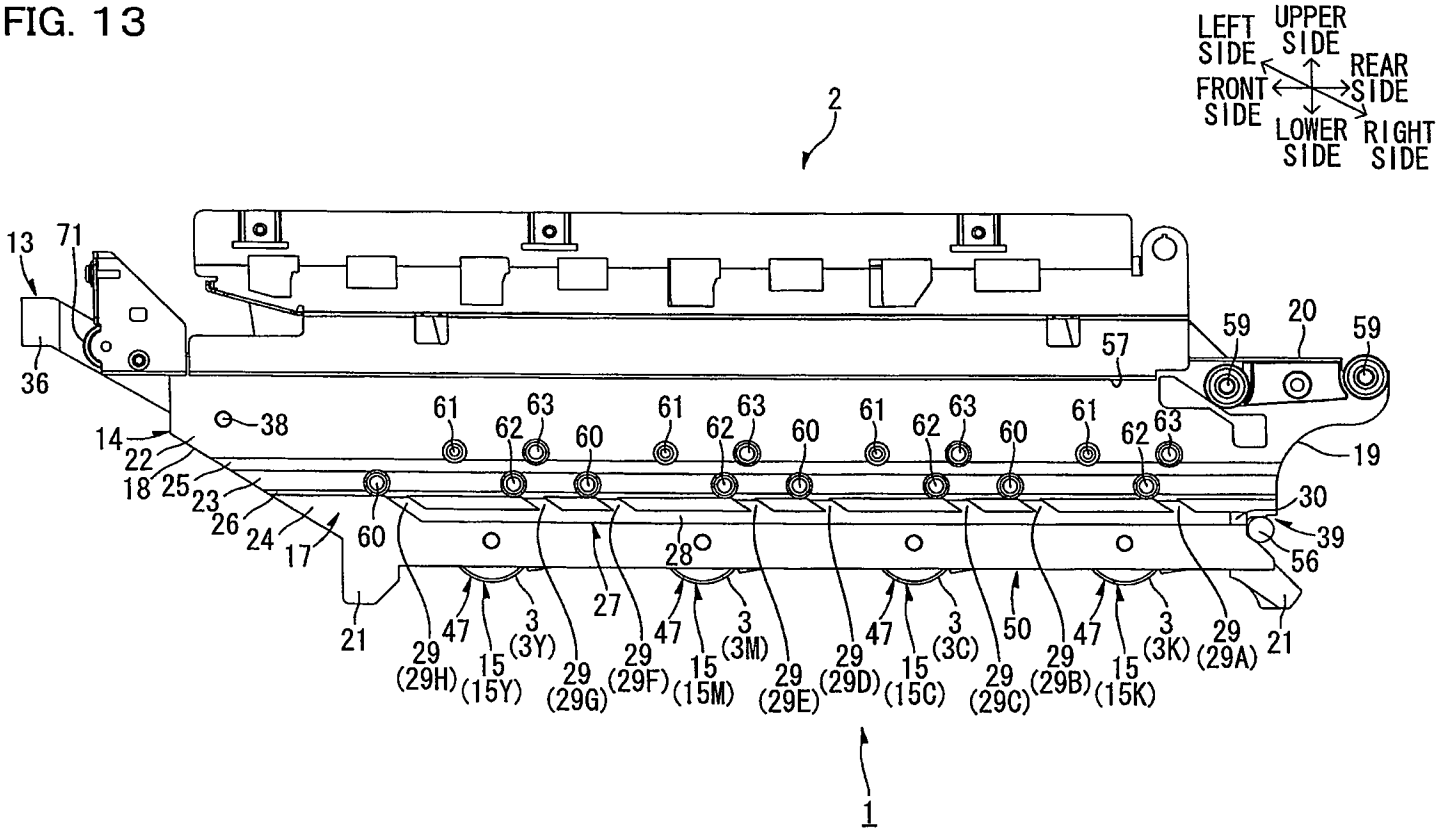
FIG. 13 is a right side elevational view of the principal part of the printer in the state shown in FIG. 11A.
Figure 14:
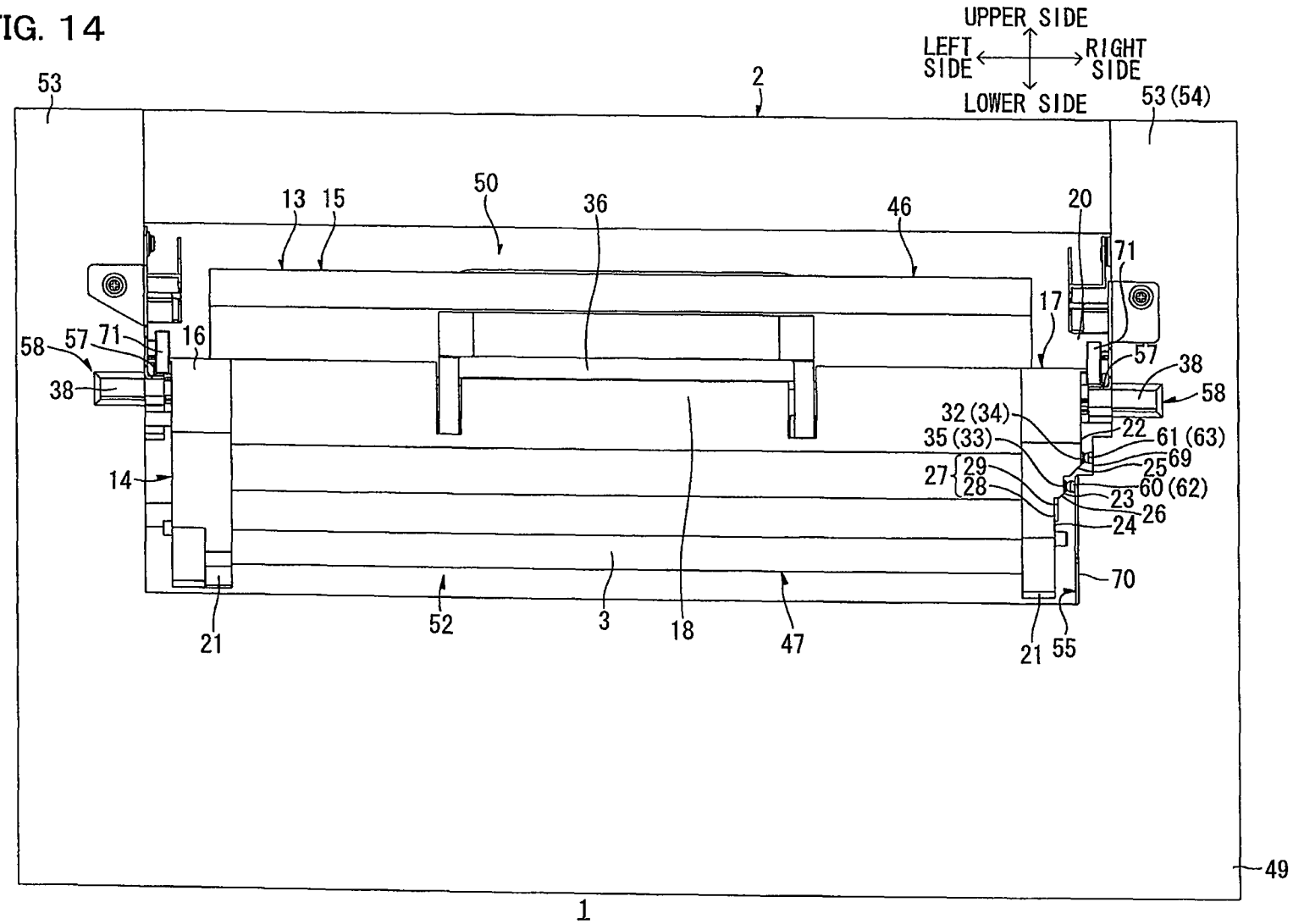
FIG. 14 is a front elevational view of the printer in the state shown in FIG. 11A.

Thus, the drum unit 13 moves obliquely downward on the rear side by the own weight thereof and the flange portions 20 thereof are placed on the guide rails 57, as shown in FIGS. 12 and 13. At the same time, the notches 39 of the drum unit 13 come into contact with the reference shaft 56 of the accommodation chamber 50 from the front side to hold the same therebetween, while both end portions of the support shaft 38 of the drum unit 13 are fitted into the corresponding recesses 58 on the front wall 49 of the main body casing 2 respectively (see FIG. 14). Thus, the drum unit 13 is arranged at the accommodated position, and completely mounted in the main body casing 2. After the drum unit 13 is completely mounted in the main body casing 2, the front cover 51 is swung to the closed position, to close the mounting port 52 of the main body casing 2 (see FIG. 1).

When the drum unit 13 is arranged at the accommodated position, each of the developing roller contacts 60, the wire contacts 61, the grid contacts 62 and the cleaning contacts 63 relatively moves obliquely upward on the front side with respect to the drum unit 13 moving obliquely downward on the rear side.

When the drum unit 13 is arranged at the accommodated position, therefore, each of the developing roller contacts 60 and the grid contacts 62 is transferred to the second coupling surface 26 continuous with the right side surface of the corresponding second rib 29 after sliding with respect to the right side surface of this corresponding second rib 29. At this time, each of the developing roller contacts 60 and the grid contacts 62 is guided rightward by the second coupling surface 26 (more specifically, a portion extending obliquely upward on the right side) against the urging force of the corresponding spring 67 (see FIG. 11B), thereafter reaches the middle right surface 23, comes into contact with the corresponding one of the developing roller electrodes 35 and the grid electrodes 33 from the right side along the width direction, and is connected thereto (see also FIGS. 11B and 14).

When the drum unit 13 is arranged at the accommodated position, further, each of the wire contacts 61 and the cleaning contacts 63 is displaced from the state (see FIGS. 7B and 10) opposed to the middle right surface 23 (the corresponding one of the grid electrodes 33 and the developing roller electrodes 35) from the right side at an interval, and received by the corresponding first coupling surface 25. At this time, each of the wire contacts 61 and the cleaning contacts 63 is guided rightward by the first coupling surface 25 (more specifically, a portion extending obliquely upward on the right side) against the urging force of the corresponding spring 67 (see FIG. 11B), thereafter reaches the upper right surface 22, comes into contact with the corresponding one of the wire electrodes 32 and the cleaning electrodes 34 from the right side along the width direction, and is connected thereto (see also FIGS. 11B and 14).

Thus, when the drum unit 13 is arranged at the accommodated position, each of the developing roller contacts 60, the wire contacts 61, the grid contacts 62 and the cleaning contacts 63 comes into contact with the corresponding one of the developing roller electrodes 35, the wire electrodes 32, the grid electrodes 33 and the cleaning electrodes 34 of the corresponding electrode groups 31 from the right side, and is connected thereto.

In order to dismount the drum unit 13 located at the accommodated position from the main body casing 2, the front cover 51 (see FIG. 1) is swung to the open position to expose the drum unit 13 from the mounting port 52 of the main body casing 2 (see FIG. 14), and the first handle 36 is grasped to draw the drum unit 13 frontward.

Thus, the drum unit 13 having been located at the accommodated position is pulled obliquely upward on the front side as shown in FIGS. 8 and 9, through a procedure reverse to the aforementioned procedure of mounting the same. Then, each of the developing roller electrodes 35, the wire electrodes 32, the grid electrodes 33 and the cleaning electrodes 34 is displaced from the corresponding one of the developing roller contacts 60, the wire contacts 61, the grid contacts 62 and the cleaning contacts 63 obliquely upward on the front side, to be released from the connection with the corresponding contact. At this time, each of the wire contacts 61 and the cleaning contacts 63 is opposed to the middle right surface 23 from the right side at an interval, while each of the developing roller contacts 60 and the grid contacts 62 is in contact with the right side surface of the first rib 28 through the corresponding second rib 29 (see FIGS. 7B and 10).

Then, the drum unit 13 is drawn out frontward along the anteroposterior direction. Thus, each of the wire contacts 61 and the cleaning contacts 63 relatively moves rearward with respect to the drum unit 13 while keeping the state opposed to the middle right surface 23 from the right side at an interval (see FIGS. 7B and 10). On the other hand, each of the developing roller contacts 60 and the grid contacts 62 also relatively moves rearward with respect to the drum unit 13, and slides with respect to the right side surface of the first rib 28 while the same is kept at the constant width-directional position (see FIGS. 7B and 10).

When the drum unit 13 is drawn out until all developing roller contacts 60 and grid contacts 62 separate from the first rib 28, the drum unit 13 is arranged at the drawn position (see FIGS. 2 to 6). Thus, the drum unit 13 can be dismounted from the main body casing 2.

Operation and Effect (1) As hereinabove described, the grid electrodes 33 and the developing roller electrodes 35 are provided on the middle right surface 23 while the wire electrodes 32 and the cleaning electrodes 34 are provided on the upper right surface 22 on the right side surface of the unit casing 14 in the drum unit 13 slidable between the accommodated position and the drawn position with respect to the accommodation chamber 50 of the main body casing 2 of the printer 1.

While the middle right surface 23 and the upper right surface 22 are opposed to the left surface 55 of the right wall 54 defining the accommodation chamber 50 in the main body casing 2 in the orthogonal direction (width direction) orthogonal to the sliding direction (anteroposterior direction) of the drum unit 13 and extend along the anteroposterior direction in parallel with each other, the upper right surface 22 protrudes toward the left surface 55 (rightward) beyond the middle right surface 23 (see FIG. 7B).

On the other hand, the left surface 55 is provided with the upper left surface 69 extending along the anteroposterior direction and the lower left surface 70 protruding toward the drum unit 13 (leftward) beyond the upper left surface 69 (see FIG. 7B). The upper left surface 69 is provided with the wire contacts 61 and the cleaning contacts 63, while the lower left surface 70 is provided with the grid contacts 62 and the developing roller contacts 60.

In this printer 1, the wire contacts 61, the cleaning contacts 63, the grid contacts 62 and the developing roller contacts 60 can come into contact with and feed power to the corresponding ones of the wire electrodes 32, the cleaning electrodes 34, the grid electrodes 33 and the developing roller electrodes 35 respectively when the drum unit 13 is located at the accommodated position, as shown in FIGS. 11A to 14.

Figure 10:
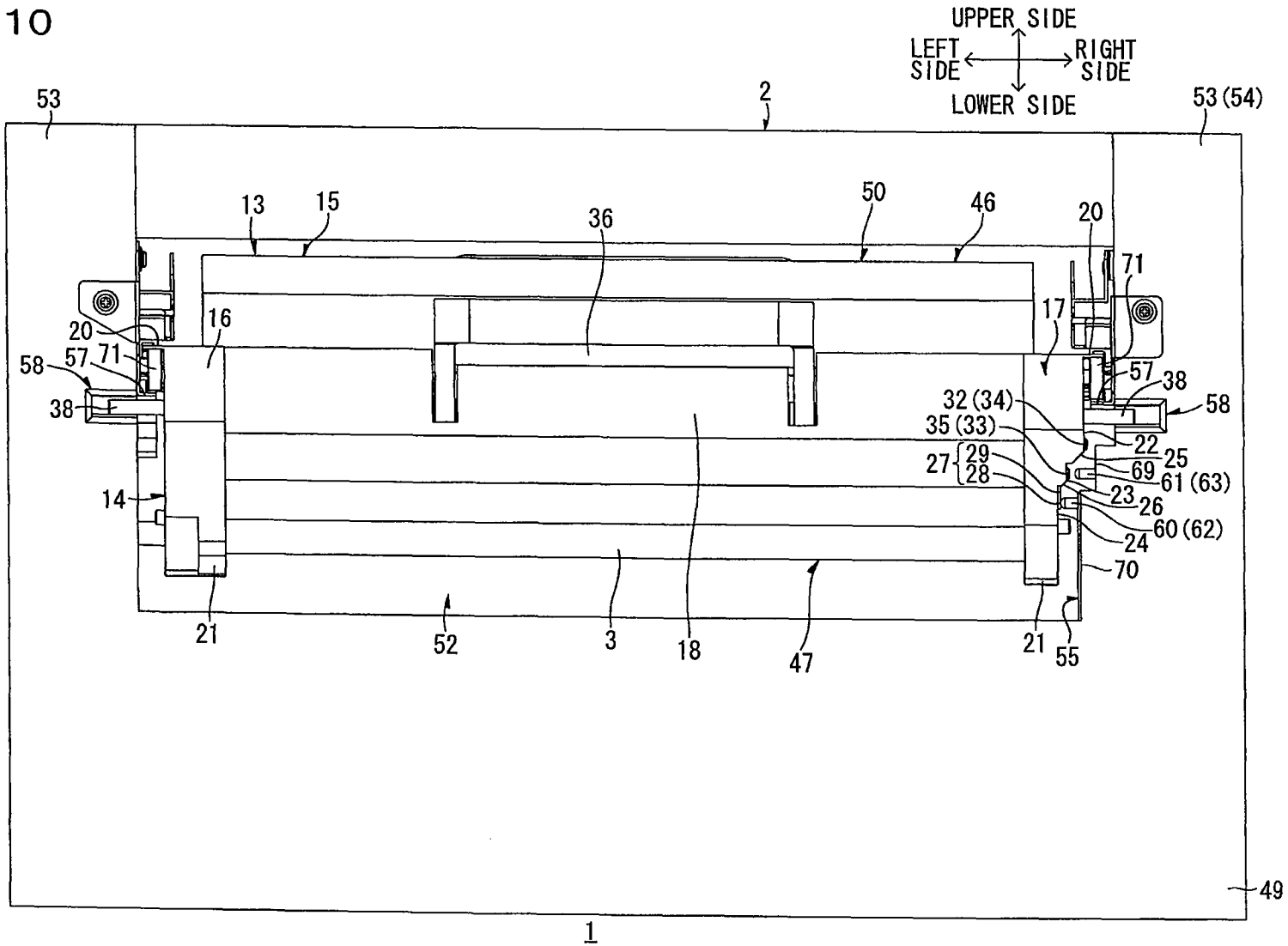
FIG. 10 is a front elevational view of the printer in the state shown in FIG. 7A.
Figure 11A:
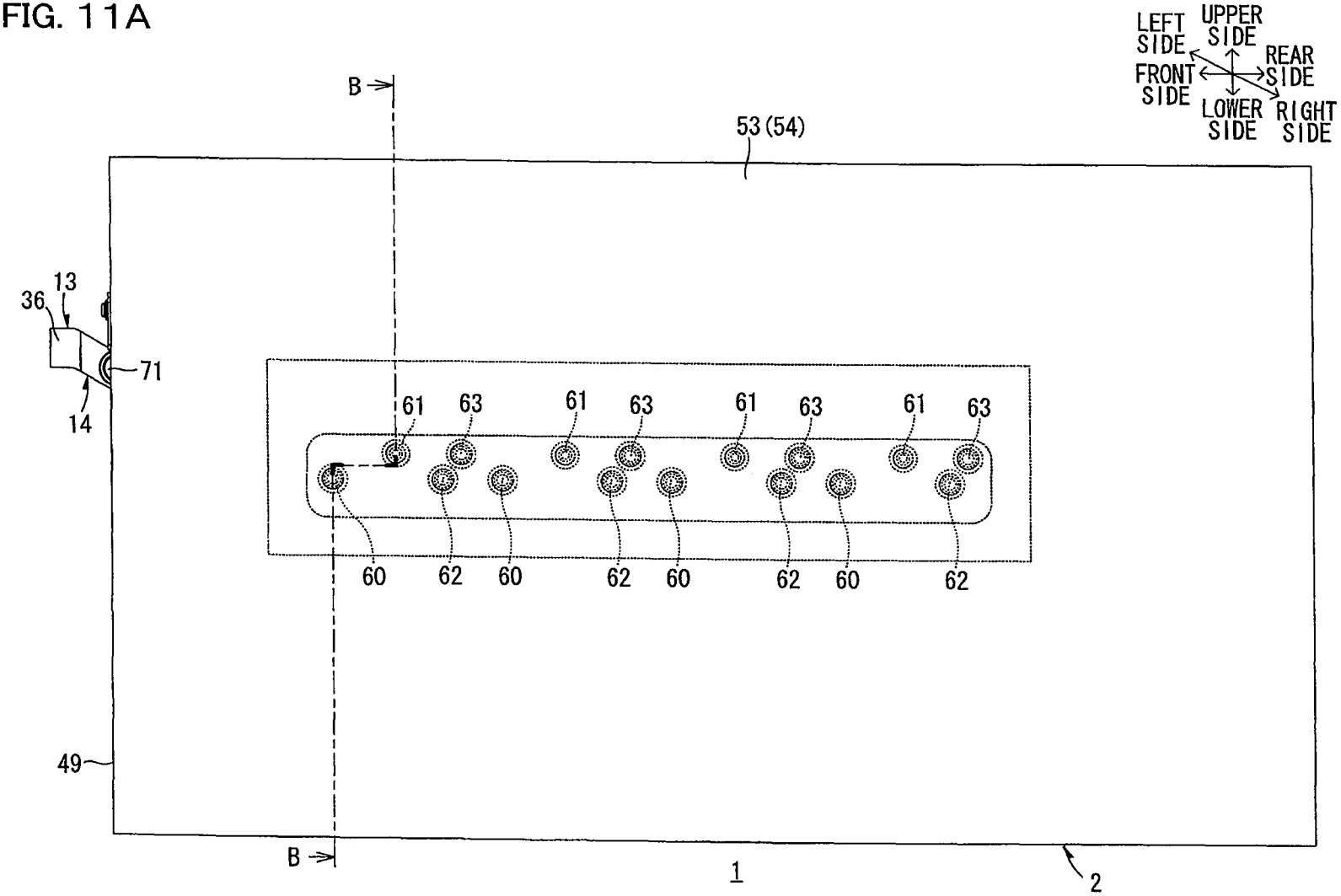
FIG. 11A is a right side elevational view of the printer in a state where the drum unit is located at the accommodated position.
Figure 11B:
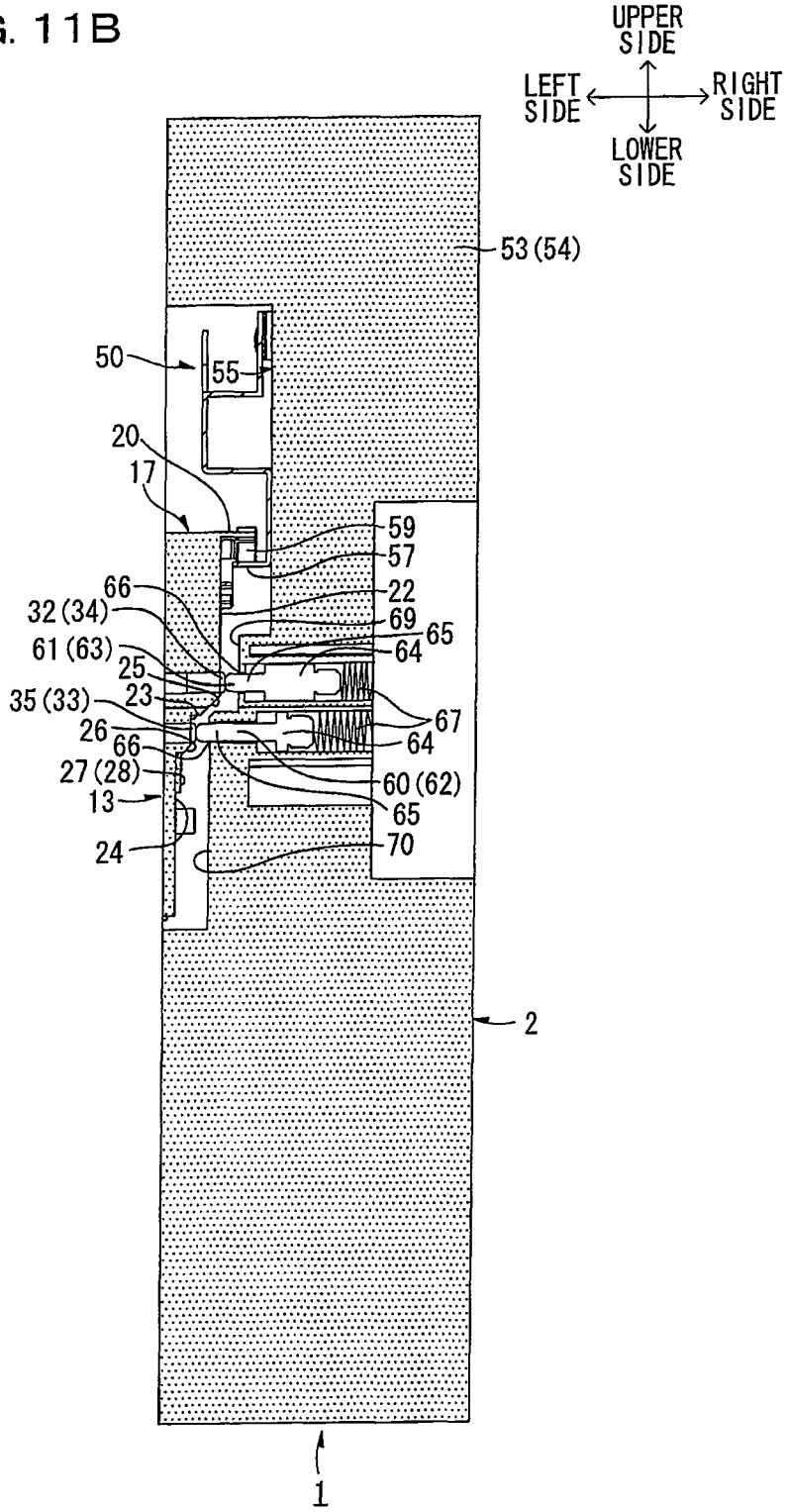
FIG. 11B is a partially fragmented sectional view of the printer taken along the line B-B in FIG. 11A.

When the drum unit 13 is located between the accommodated position and the drawn position, on the other hand, the wire contacts 61 and the cleaning contacts 63 are opposed to the grid electrodes 33 and the developing roller electrodes 35 at intervals in the width direction as viewed from the anteroposterior direction, while the grid contacts 62 and the developing roller contacts 60 are opposed to the lower right surface 24 of the drum unit 13 in the width direction, as shown in FIGS. 7B and 10. Thus, the wire electrodes 32, the cleaning electrodes 34, the grid electrodes 33 and the developing roller electrodes 35 can be prevented from unnecessary contact with the wire contacts 61, the cleaning contacts 63, the grid contacts 62 and the developing roller contacts 60 when the drum unit 13 is located between the accommodated position and the drawn position.

The upper right surface 22 protrudes rightward beyond the middle right surface 23 in the drum unit 13, whereby the grid electrodes 33 and the developing roller electrodes 35 provided on the middle right surface 23, and, the wire electrodes 32 and the cleaning electrodes 34 provided on the upper right surface 22, can be separated from one another in the width direction. Thus, the train X of the wire electrodes 32 and the cleaning electrodes 34, and, the train Y of the grid electrodes 33 and the developing roller electrodes 35, can be so arranged that the interval (vertical interval) therebetween is narrowed as viewed from the width direction while the trains X and Y are insulated from each other (the insulation distance is maintained), as shown in FIGS. 4 and 6.

(2) When the drum unit 13 moves between the accommodated position and the drawn position, the lower right surface 24 (more strictly, the right side surface of the first rib 28 provided on the lower right surface 24) flatly formed in the width direction maintains the grid contacts 62 and the developing contacts 60, slidably coming into contact with the lower right surface 24, at the constant width-directional positions (see FIGS. 7B and 10). When the drum unit 13 moves between the accommodated position and the drawn position, therefore, the grid contacts 62 and the developing roller contacts 60 can be prevented from inhibiting movement of the drum unit 13 by unexpectedly moving in the width direction and interfering with the drum unit 13.

Second Embodiment

While each subunit 15 can be separated into the first and second subunits 46 and 47 in the drum unit 13 according to the aforementioned embodiment as shown in FIG. 1, the first and second subunits 46 and 47 may alternatively be integrally formed. In this case, consumable parts such as the toner accommodated in the toner accommodation chamber 40 and the developing roller 5 in the first subunit 46 and the photosensitive drum 3 in the second subunit 47 can be simultaneously exchanged by exchanging the subunit 15.

While the above embodiment has been described with reference to the so-called direct transfer color laser printer 1 directly transferring the toner image from each photosensitive drum 3 to the sheet P, one or more aspects of the present invention is not restricted to this but may alternatively as apply to an intermediate transfer color laser printer temporarily transferring toner images of respective colors from the photosensitive drums 3 to an intermediate transfer body and thereafter collectively transferring the same to the sheet P.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus comprising:

a main body comprising a first electrode;

a cartridge configured to accommodate toner; and a moving unit configured to support the cartridge and to slide in a generally horizontal sliding direction between a first inside position where the moving unit is located inside the main body and an outside position where the moving unit is located outside the main body, the moving unit being further configured to move between the first inside position and a second inside position which is located below the first inside position, the moving unit comprising a second electrode which is configured to electrically connect to the first electrode after the moving unit moves from the first inside position to the second inside position.

2. The image forming apparatus according to claim 1, wherein the main body further comprises a third electrode located below the first electrode, and the moving unit further comprises a fourth electrode located below the second electrode and configured to electrically connect to the third electrode.

3. The image forming apparatus according to claim 2, wherein the main body has a first inner side surface on which the first electrode is disposed and a second inner side surface on which the third electrode is disposed, the second inner side surface extending closer to the moving unit than the first inner side surface, wherein the moving unit has a first outer side surface on which the fourth electrode is disposed and a second outer side surface on which the second electrode is disposed, the second outer side surface extending closer to the first inner side surface of the main body than the first outer side surface.

4. The image forming apparatus according to claim 2, wherein the fourth electrode is configured to electrically connect to the third electrode after the moving unit moves from the first inside position to the second inside position.

5. The image forming apparatus according to claim 1, wherein the moving unit has a handle.

* * * * *